US011524503B2

(12) United States Patent
Okamura et al.

(10) Patent No.: US 11,524,503 B2
(45) Date of Patent: Dec. 13, 2022

(54) LIQUID EJECTING HEAD AND LIQUID EJECTING APPARATUS

(71) Applicant: SEIKO EPSON CORPORATION, Tokyo (JP)

(72) Inventors: Yu Okamura, Matsumoto (JP); Masahiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 48 days.

(21) Appl. No.: 17/145,993

(22) Filed: Jan. 11, 2021

(65) Prior Publication Data

US 2021/0213752 A1 Jul. 15, 2021

(30) Foreign Application Priority Data

Jan. 14, 2020 (JP) ..... JP2020-003442

(51) Int. Cl.
*B41J 2/175* (2006.01)
*B41J 2/14* (2006.01)

(52) U.S. Cl.
CPC ..... *B41J 2/17553* (2013.01); *B41J 2/14201* (2013.01); *B41J 2/17513* (2013.01)

(58) Field of Classification Search
CPC ..... B41J 2/17553; B41J 2/14201; B41J 2/17513; B41J 2/145; B41J 2202/19; B41J 2202/20; B41J 2/17509; B41J 2/01; B41J 2/14
See application file for complete search history.

(56) References Cited

U.S. PATENT DOCUMENTS

| | | | |
|---|---|---|---|
| 5,693,901 A | 12/1997 | Matsunaga | |
| 2008/0231653 A1 | 9/2008 | Kawashima et al. | |
| 2020/0156372 A1 | 5/2020 | Okamura et al. | |

FOREIGN PATENT DOCUMENTS

| | | | |
|---|---|---|---|
| JP | H03-136862 A | 6/1991 | |
| JP | 3227653 A | * 10/1991 | ..... B41J 2/17503 |
| JP | H03-227653 A | 10/1991 | |
| JP | H03-246038 A | 11/1991 | |
| JP | H07-060980 A | 3/1995 | |
| JP | 2003-159812 A | 6/2003 | |
| JP | 2012-166554 A | 9/2012 | |
| JP | 2019-130810 A | 8/2019 | |
| JP | 2020-082444 A | 6/2020 | |

OTHER PUBLICATIONS

IP.com search (Year: 2022).*

* cited by examiner

*Primary Examiner* — Lisa Solomon
(74) *Attorney, Agent, or Firm* — Workman Nydegger

(57) ABSTRACT

A liquid ejecting head configured to eject a liquid in a first direction includes an upper surface facing a direction opposite to the first direction, and a gripping portion provided on the upper surface to grip the liquid ejecting head.

11 Claims, 20 Drawing Sheets

LIQUID EJECTING HEAD AND LIQUID EJECTING APPARATUS

The present application is based on, and claims priority from JP Application Serial Number 2020-003442, filed Jan. 14, 2020, the disclosure of which is hereby incorporated by reference herein in its entirety.

BACKGROUND

1. Technical Field

The present disclosure relates to a liquid ejecting head and a liquid ejecting apparatus.

2. Related Art

In the related art, an ink jet apparatus equipped with a plurality of heads that eject a liquid such as an ink from a plurality of nozzles has been proposed. For example, JP-A-2019-130810 discloses a liquid ejecting apparatus in which a plurality of heads are aligned on a carriage along a short direction of the heads.

When the plurality of heads are densely disposed on the carriage as in the liquid ejecting apparatus disclosed in JP-A-2019-130810, a distance between the heads adjacent to each other is narrowed. Consequently, the head is less likely to be gripped when the head is replaced, thereby resulting in poor maintenance workability in some cases.

SUMMARY

According to an aspect of the present disclosure, there is provided a liquid ejecting head for ejecting a liquid in a first direction. The liquid ejecting head includes an upper surface facing a direction opposite to the first direction, and a gripping portion provided on the upper surface and gripped to move the liquid ejecting head.

DESCRIPTION OF EXEMPLARY EMBODIMENTS

A: Embodiment

Figure 2:
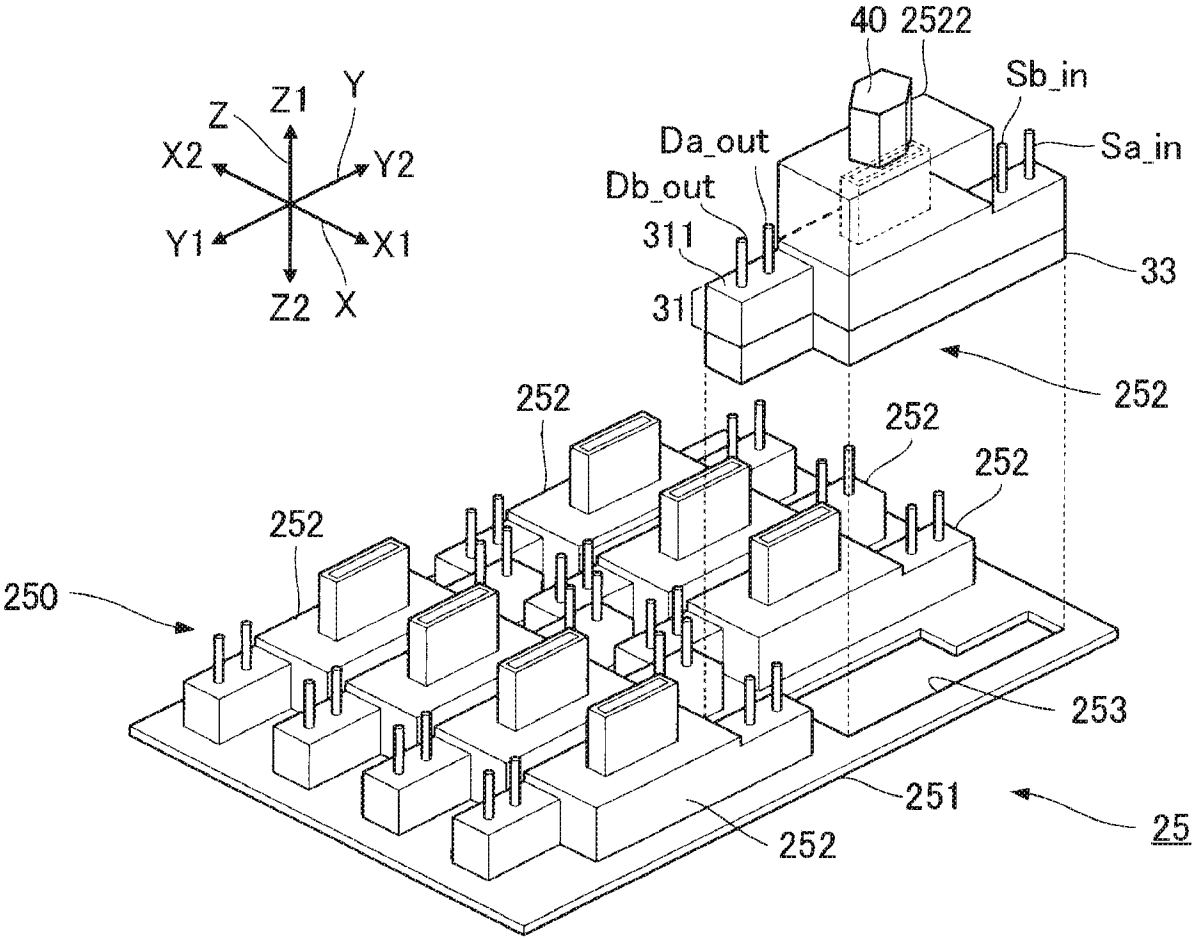
FIG. 2 is an exploded perspective view of a liquid ejecting unit.

In the following description, an X-axis, a Y-axis, and a Z-axis which are orthogonal to each other are assumed. The X-axis, the Y-axis, and the Z-axis are common in all drawings exemplified in the following description. As illustrated in FIG. 2, one direction along the X-axis when viewed from any desired point will be referred to as an X1-direction, and a direction opposite to the X1-direction will be referred to as an X2-direction. Similarly, directions opposite to each other along the Y-axis from any desired point will be referred to as a Y1-direction and a Y2-direction, and directions opposite to each other the Z-axis from any desired point will be referred to as a Z1-direction and a Z2-direction. An X-Y-plane including the X-axis and the Y-axis corresponds to a horizontal plane. The Z-axis is an axis along a vertical direction, and the Z2-direction corresponds to a downward direction in the vertical direction.

Figure 1:
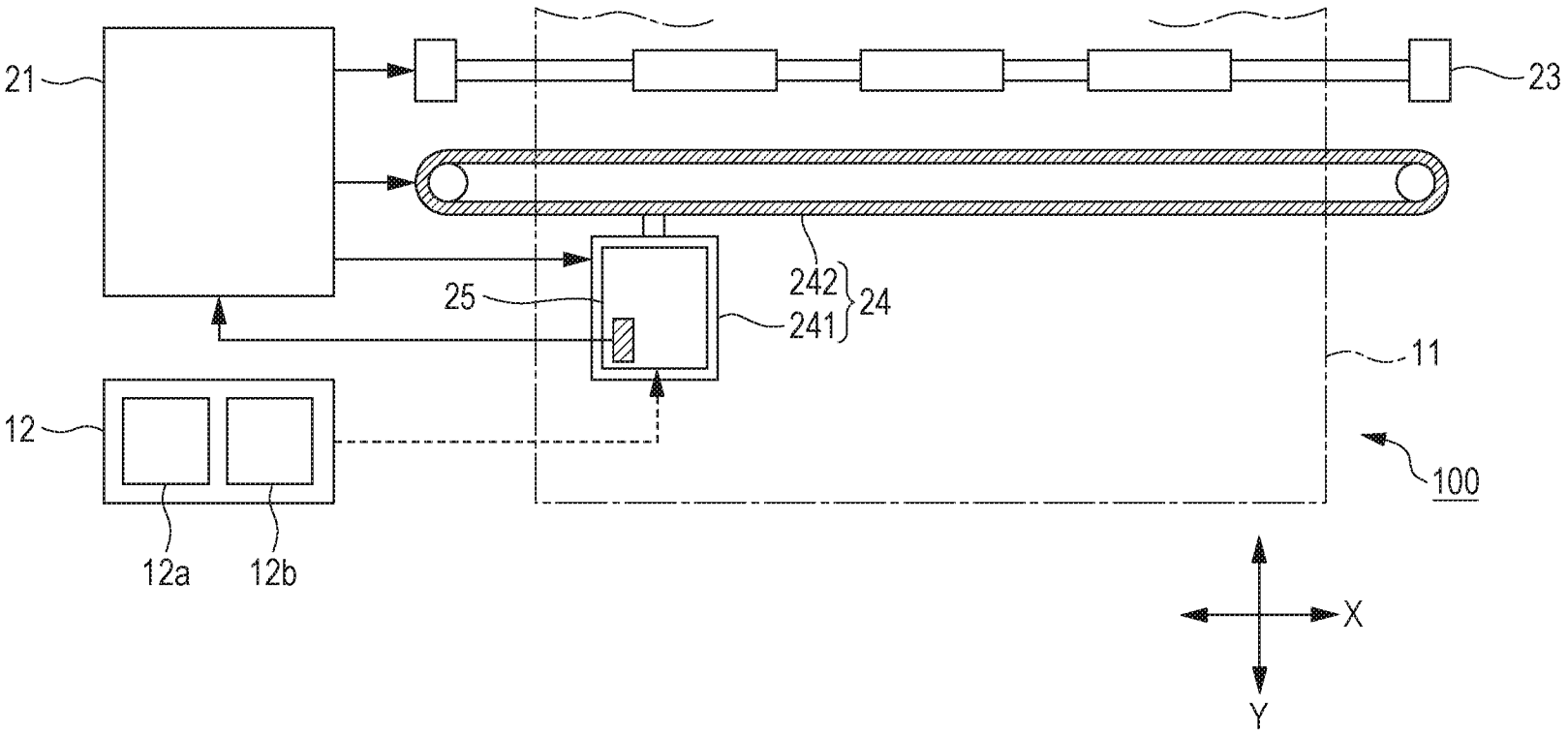
FIG. 1 is a view illustrating a configuration example of a liquid ejecting apparatus according to the present embodiment.

FIG. 1 is a view illustrating a configuration example of a liquid ejecting apparatus 100 according to the present embodiment. The liquid ejecting apparatus 100 is an ink jet printing apparatus that ejects an ink droplet which is an example of a liquid, onto a medium 11. The medium 11 is typically a printing sheet. However, for example, a print target formed of any desired material such as a resin film or a cloth is used as the medium 11.

The liquid ejecting apparatus 100 has a liquid container 12 as illustrated in FIG. 1. The liquid container 12 stores an ink. For example, the liquid container 12 is a cartridge that is attachable to and detachable from the liquid ejecting apparatus 100, a bag-shaped ink pack formed of a flexible film, or an ink tank that can replenish the ink.

As illustrated in FIG. 1, the liquid container 12 has a first liquid container 12*a* and a second liquid container 12*b*. The first liquid container 12*a* stores a first ink, and the second liquid container 12*b* stores a second ink. The first and second inks may be mutually different types of the ink, or may be the same type of the ink.

As illustrated in FIG. 1, the liquid ejecting apparatus 100 has a control unit 21, a transport mechanism 23, a movement mechanism 24, and a liquid ejecting unit 25. The control unit 21 controls each element of the liquid ejecting apparatus 100.

For example, the control unit 21 has a processing circuit such as a central processing unit (CPU) or a field programmable gate array (FPGA), and a storage circuit such as a semiconductor memory.

The transport mechanism 23 transports the medium 11 along the Y-axis, based on a control of the control unit 21. The movement mechanism 24 causes the liquid ejecting unit 25 to reciprocate along the X-axis, based on a control of the control unit 21. The movement mechanism 24 has a substantially box-shaped transport body 241 that accommodates the liquid ejecting unit 25, and an endless belt 242 to which the transport body 241 is fixed. A configuration in which the transport body 241 is equipped with the liquid container 12 together with the liquid ejecting unit 25 may also be adopted.

The liquid ejecting unit 25 ejects the ink supplied from the liquid container 12 through each of a plurality of nozzles onto the medium 11, based on a control of the control unit 21. The medium 11 is transported by the transport mechanism 23, and concurrently, the transport body 241 repeatedly reciprocates. In this manner, an image is formed on a surface of the medium 11 by the liquid ejecting unit 25 ejecting the ink onto the medium 11.

FIG. 2 is an exploded perspective view of the liquid ejecting unit 25. The liquid ejecting unit 25 according to the present embodiment has a holding member 251 and a head unit 250. The holding member 251 is a plate-shaped member that holds the head unit 250 to be attachable and detachable, and has a plurality of attachment holes 253. In FIG. 2, for convenience, a cover unit 2522 is illustrated for only one liquid ejecting head 252. However, actually, the other liquid ejecting head 252 similarly includes the cover unit 2522. The holding member 251 may be formed integrally with the transport body 241, or may be separate from the transport body 241. In addition, the holding member 251 is not limited to the configuration provided in the transport body 241, and may adopt a configuration in which the liquid ejecting unit 25 is not moved along the X-axis as in a line ink jet printer, that is, a configuration in which the holding member 251 is not moved along the X-axis by the movement mechanism 24.

The head unit 250 is configured to include a plurality of liquid ejecting heads 252. Each of the plurality of liquid ejecting heads 252 ejects an ink droplet under a control of the control unit 21. That is, the control unit 21 functions as an ejection control portion that controls ejection of the ink ejected by the liquid ejecting head 252.

As illustrated in FIG. 2, the liquid ejecting head 252 has a housing 31, a cover unit 2522, and a holding body 33. The housing 31 is located between the cover unit 2522 and the holding body 33. Specifically, the holding body 33 is disposed in the Z2-direction when viewed from the housing 31, and the cover unit 2522 is disposed in the Z1-direction when viewed from the holding body 33.

Figure 3:
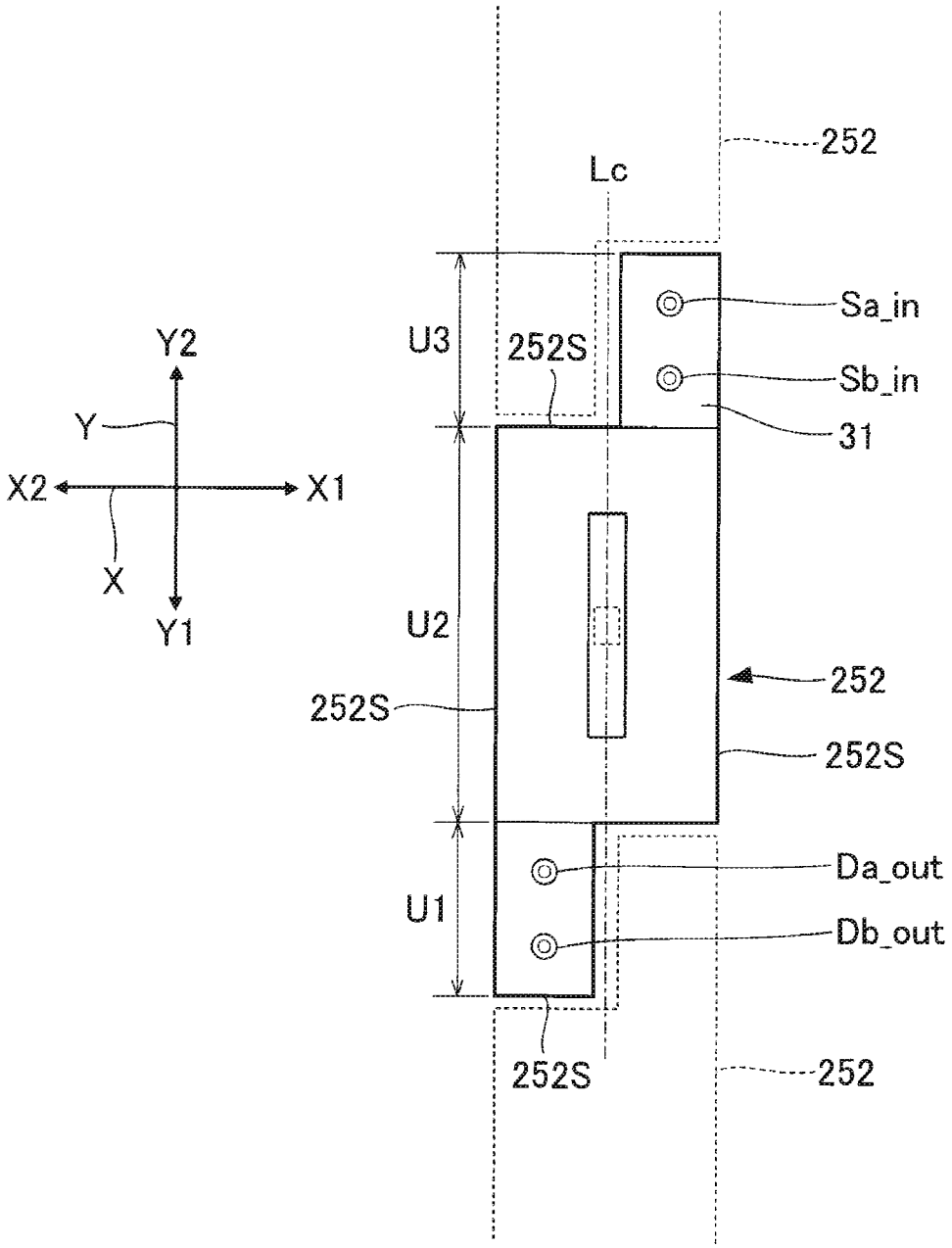
FIG. 3 is a plan view of a liquid ejecting head.

FIG. 3 is a plan view when the liquid ejecting head 252 is viewed in the Z1-direction. In FIG. 3, the cover unit 2522 is omitted in the illustration. As illustrated in FIG. 3, the housing 31 and the holding body 33 of the respective liquid ejecting heads 252 are configured to have an outer shape including a first portion U1, a second portion U2, and a third portion U3 in a plan view along the Z-axis. The housing 31 and the holding body 33 have a plurality of side surfaces 252S extending along both the Z-axis and a direction orthogonal to the Z-axis.

The first portion U1, the second portion U2, and the third portion U3 are arrayed along the Y-axis. The second portion U2 is located between the first portion U1 and the third portion U3. Specifically, the first portion U1 is located in the Y1-direction with respect to the second portion U2, and the third portion U3 is located in the Y2-direction with respect to the second portion U2. The cover unit 2522 is disposed in an outer shape corresponding to the second portion U2.

FIG. 3 illustrates a center line Lc of the second portion U2 along the Y-axis. The first portion U1 is located in the X2-direction with respect to the center line Lc, and the third portion U3 is located in the X1-direction with respect to the center line Lc. That is, the first portion U1 and the third portion U3 are located in opposite directions across the center line Lc. As illustrated in FIG. 3, the plurality of liquid ejecting heads 252 are arrayed along the Y-axis so that the third portion U3 of each liquid ejecting head 252 and the first portion U1 of another liquid ejecting head 252 are adjacent to each other in a direction of the X-axis. As illustrated in FIG. 3, the first portion U1 has a first discharge port Da_out and a second discharge port Db_out, and the third portion U3 has a first supply port Sa_in and a second supply port Sb_in.

Figure 4:
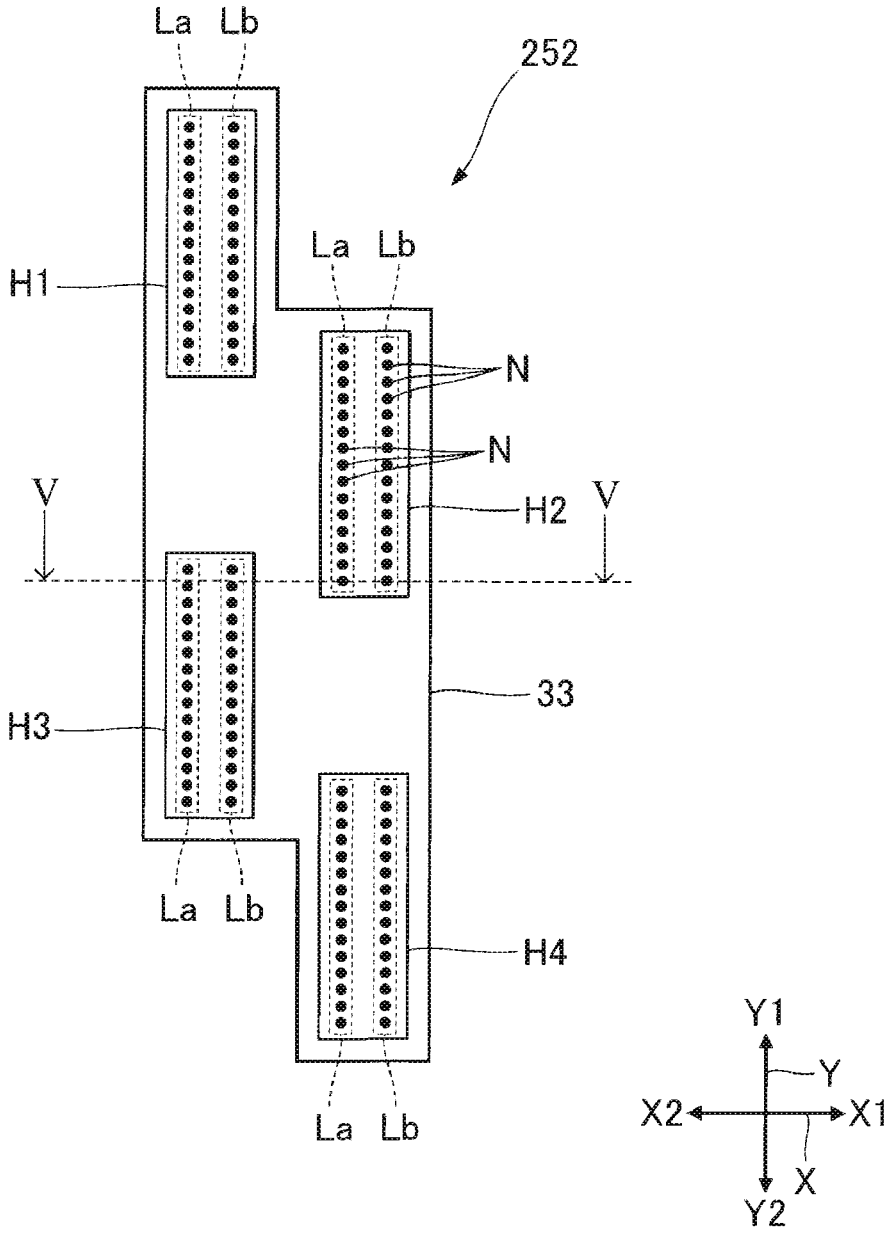
FIG. 4 is a plan view when the liquid ejecting head is viewed in an ejecting direction.

FIG. 4 is a plan view when the liquid ejecting head 252 is viewed in the Z2-direction. As illustrated in FIG. 4, the liquid ejecting head 252 includes four heads H1 to H4. The holding body 33 in FIG. 2 is a structure that accommodates and supports the four heads H1 to H4. Each head Hn (n=1 to 4) ejects the ink from a plurality of nozzles N. As illustrated in FIG. 4, the plurality of nozzles N are divided into a first nozzle row La and a second nozzle row Lb. Each of the first nozzle row La and the second nozzle row Lb is a set of the plurality of nozzles N arrayed along the Y-axis. The first nozzle row La and the second nozzle row Lb are juxtaposed with each other in the direction of the X-axis with a distance therebetween.

The first ink introduced from the first liquid container 12*a* into the first supply port Sa_in is supplied to each head Hn by way of a flow path structure body (not illustrated) provided inside the housing 31, and is ejected from each nozzle N of the first nozzle row La in each head Hn. The first ink which is not ejected from the nozzle N of each head Hn is discharged from the first discharge port Da_out by way of a flow path structure body (not illustrated). The first ink discharged from the first discharge port Da_out is circulated to the first supply port Sa_in by a circulation mechanism (not illustrated).

Similarly, the second ink introduced from the second liquid container 12*b* into the second supply port Sb_in is supplied to each head Hn by way of a flow path structure body (not illustrated), and is ejected from each nozzle N of the second nozzle row Lb in each head Hn. The second ink which is not ejected from the nozzle N of each head Hn is discharged from the second discharge port Db_out by way of a flow path structure body (not illustrated). The second ink discharged from the second discharge port Db_out is circulated to the second supply port Sb_in by a circulation mechanism (not illustrated).

Figure 5:
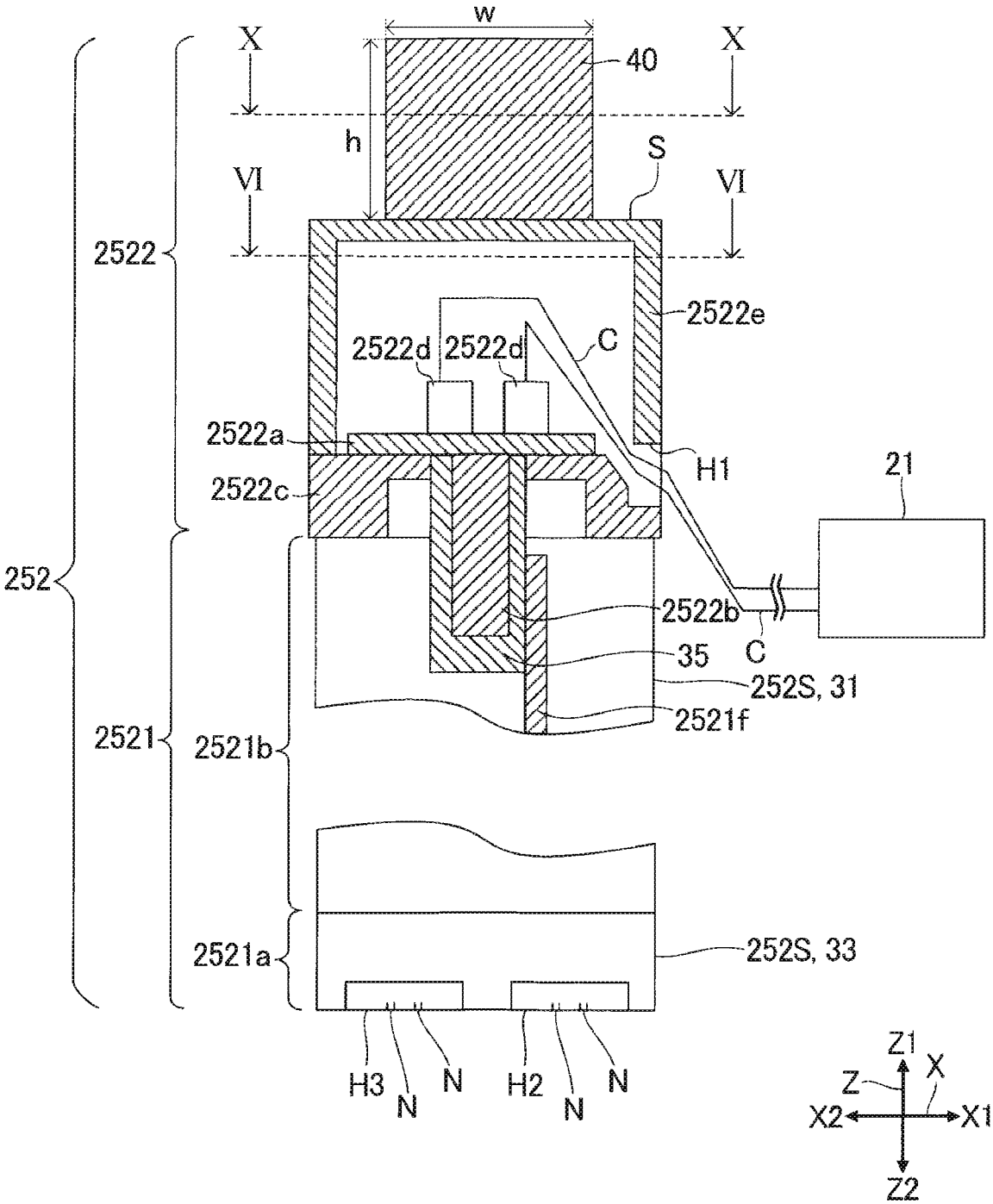
FIG. 5 is a cross-sectional view taken along line V-V in FIG. 4.

FIG. 5 is a cross-sectional view taken along line V-V in FIG. 4. As illustrated in FIG. 5, the liquid ejecting head 252 has a main body portion 2521 and a cover unit 2522. A connector 35 is provided on a surface of the liquid ejecting head 252 opposite to the Z2-direction in which ink is ejected. The cover unit 2522 is coupled to the main body portion 2521 via the connector 35, and is screwed to the main body portion 2521.

The main body portion 2521 has a first structure portion 2521*a* and a second structure portion 2521*b*. The first structure portion 2521*a* has a plurality of pressure generation chambers, a plurality of nozzles N, and a piezoelectric element.

The plurality of nozzles N and the plurality of pressure generation chambers, and a flow path for supplying the ink to each pressure generation chamber are formed inside the first structure portion 2521*a*. The pressure generation chamber is a space formed for each nozzle N, and communicates with the nozzle N. The piezoelectric element is displaced when a drive signal is supplied. A volume of the pressure generation chamber is changed due to the displacement of the piezoelectric element. Accordingly, the ink inside the pressure generation chamber is ejected from the nozzle.

The second structure portion 2521*b* includes a circuit board 2521*f*. The connector 35 is disposed on the circuit board 2521*f*. The cover unit 2522 has a relay substrate 2522*a*. An attachable-detachable connector 2522*b* coupled to the main body portion 2521 by being inserted into the connector 35 is disposed in the relay substrate 2522*a*. The attachable-detachable connector 2522*b* is inserted into the connector 35 so that the connector 35 and the attachable-detachable connector 2522*b* are electrically coupled to each other. The circuit board 2521*f* receives a drive signal from the control unit 21 via the connector 35. The drive signal is supplied to the piezoelectric element.

Figure 6:
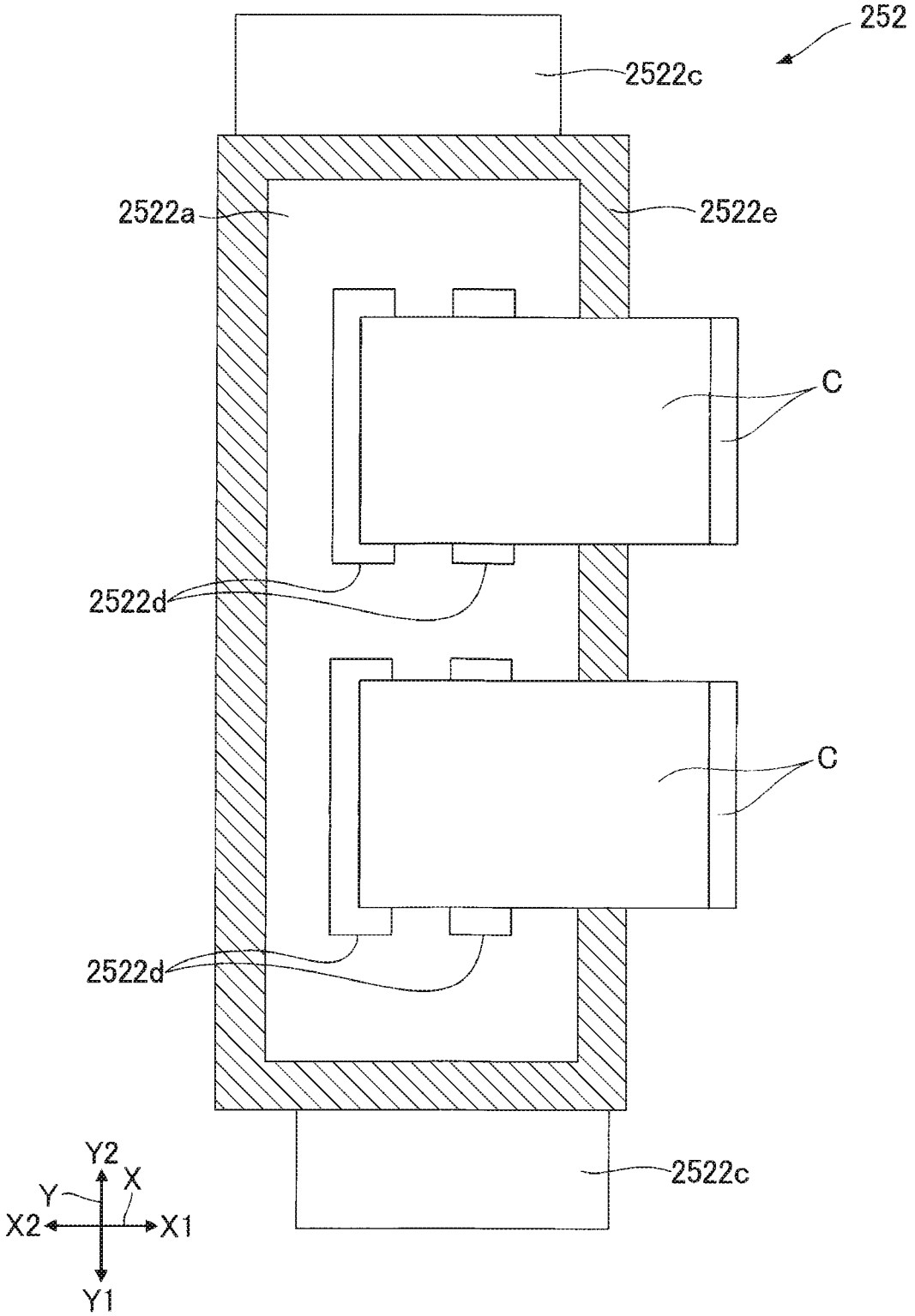
FIG. 6 is a cross-sectional view taken along line VI-VI in FIG. 5.

FIG. 6 is a cross-sectional view taken along line VI-VI in FIG. 5. As illustrated in FIGS. 5 and 6, the cover unit 2522 has a cover portion 2522*e* and a substrate fixing portion 2522*c*. The relay substrate 2522*a* is disposed in a space surrounded by the substrate fixing portion 2522*c* and the cover portion 2522*e*. The cover portion 2522*e* protects the relay substrate 2522*a*. The substrate fixing portion 2522*c* fixes the relay substrate 2522*a* to the cover portion 2522*e*.

As illustrated in FIG. 5, the relay substrate 2522*a* is provided with a cable connector 2522*d* and an attachable-detachable connector 2522*b*. The cable connector 2522*d* is coupled to a cable C, and the cable C is electrically coupled to the control unit 21. The cable C transmits the drive signal from the control unit 21 to the relay substrate 2522*a*. The relay substrate 2522*a* relays the drive signal to the main body portion 2521.

Each terminal of the cable connector 2522*d* and each terminal of the attachable-detachable connector 2522*b* are electrically coupled to each other. The drive signal output from the control unit 21 is supplied to the circuit board 2521*f* by way of the cable C, the cable connector 2522*d*, and the attachable-detachable connector 2522*b* in this order.

As illustrated in FIG. 5, the cover unit 2522 has an opening portion H. The cable C is drawn outward via the opening portion H. As illustrated in the drawing, the cover unit 2522 covers the cable C and the cable connector 2522*d* in the Z1-direction.

The cable connector 2522*d* is electrically coupled to the cable C. The liquid ejecting head 252 receives the drive signal from the control unit 21 via the cable C, and performs an ejecting operation based on the drive signal.

As illustrated in FIG. 2, the head unit 250 is configured to include the plurality of liquid ejecting heads 252 having the same structure. The liquid ejecting head 252 ejects the ink in the Z2-direction. In the liquid ejecting head 252, the X1-direction is set as a short direction, and the Y2-direction is set as a longitudinal direction.

Each of the plurality of liquid ejecting heads 252 is held by the holding member 251 in a state of being inserted into the attachment hole 253. As illustrated in FIG. 2, the liquid ejecting head 252 has a gripping portion 40. The gripping portion 40 functions as a knob (holder) of the liquid ejecting head 252. The gripping portion 40 will be described later.

The plurality of liquid ejecting heads 252 are arrayed with an equal distance in a matrix along the X-axis and the Y-axis. In a preferable aspect of the present disclosure, the liquid ejecting heads 252 adjacent to each other in the X-axis direction have a relationship in which both of these are inverted by 180° around the Z-axis. According to this configuration, when the first supply port Sa_in and the second supply port Sb_in of the head selected in any desired way from the plurality of liquid ejecting heads 252 are located in the Y2-direction, and the first discharge port Da_out and the second discharge port Db_out are located in the Y1-direction, the first supply port Sa_in and the second supply port Sb_in of the head adjacent to the selected head in the X-axis direction are located in the Y1-direction, and the first discharge port Da_out and the second discharge port Db_out are located in the Y2-direction.

The number of the liquid ejecting heads 252 and the array of the liquid ejecting heads 252 are not limited to the example illustrated in FIG. 2. Hereinafter, some application examples of the array of the liquid ejecting heads 252 will be described.

Application Example 1

Figure 7:
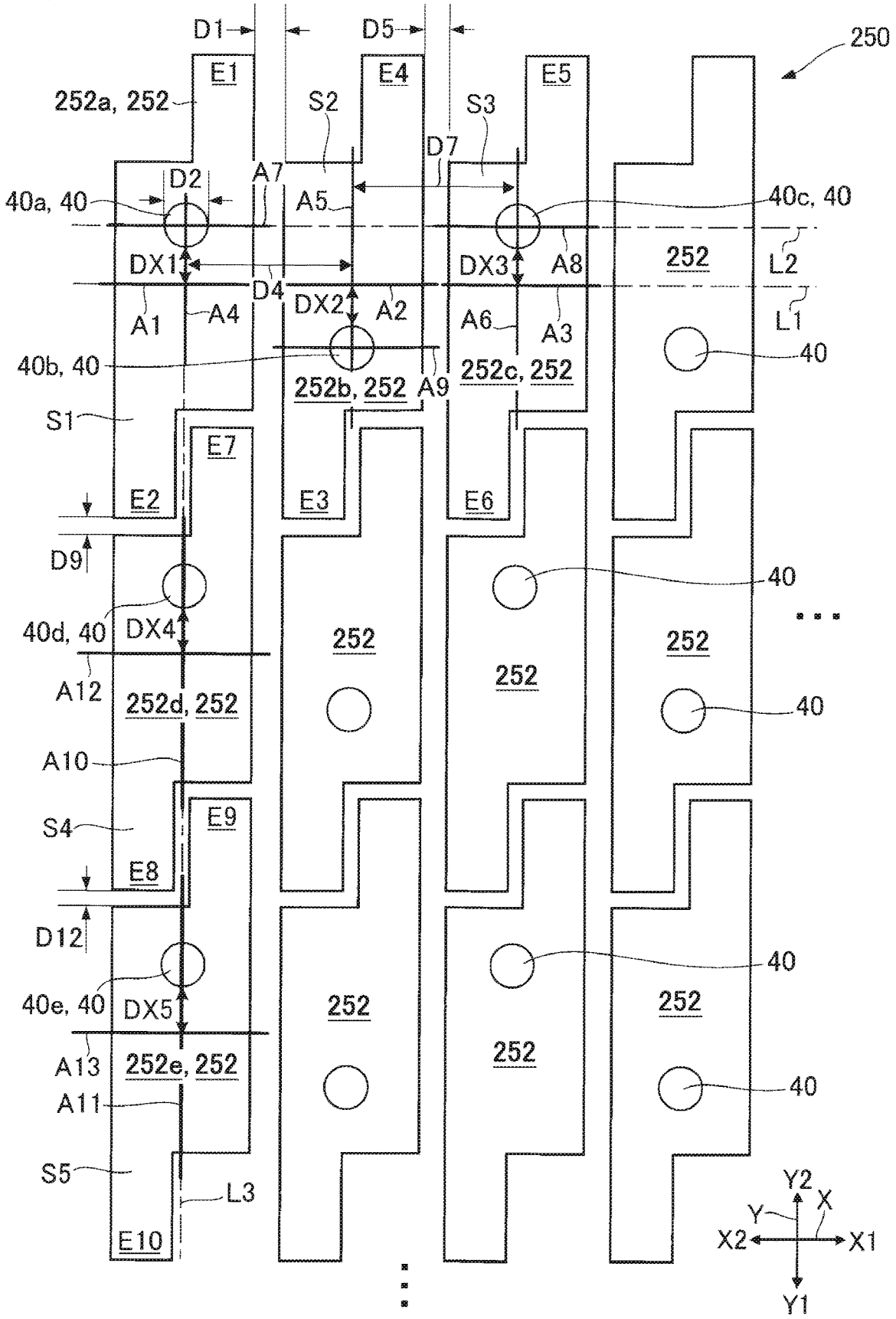
FIG. 7 is a schematic view illustrating an example of an array of liquid ejecting heads.
Figure 8:
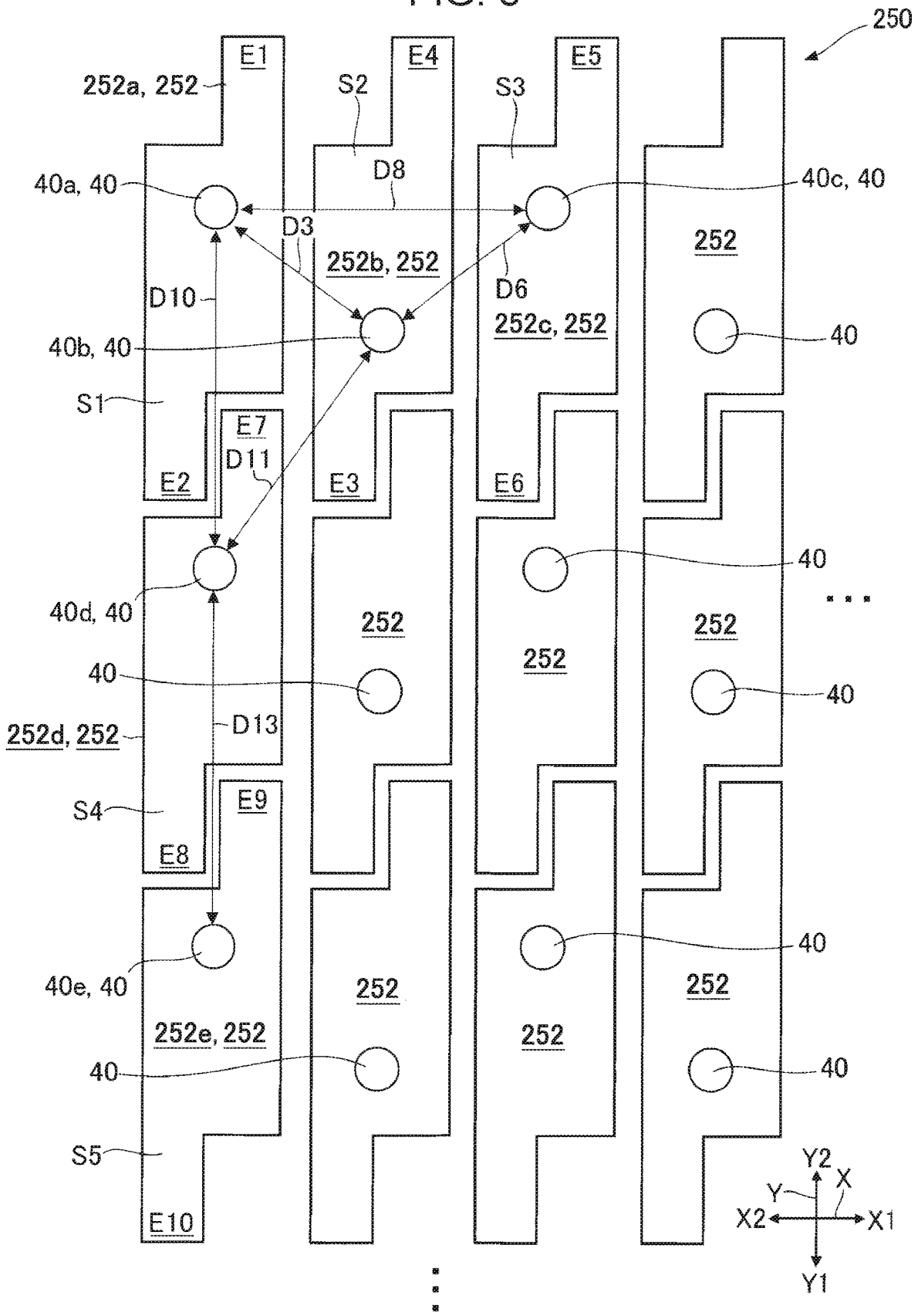
FIG. 8 is a schematic view illustrating an example of an array of the liquid ejecting heads.

FIGS. 7 and 8 are schematic views illustrating an example of the array of the liquid ejecting heads 252. The head unit 250 includes a first liquid ejecting head 252*a* (first head), a second liquid ejecting head 252*b* (second head), a third liquid ejecting head 252*c* (third head), a fourth liquid ejecting head 252*d* (fourth head), and a fifth liquid ejecting head 252*e* (fifth head).

As illustrated in FIG. 7, the first liquid ejecting head 252*a*, the second liquid ejecting head 252*b*, and the third liquid ejecting head 252*c* are disposed at the same position in the Y2-direction. Specifically, the first liquid ejecting head 252*a*, the second liquid ejecting head 252*b*, and the third liquid ejecting head 252*c* are located on the mutually same straight line L1.

More specifically, a center axis A1 extending along the X-axis through a center of the first liquid ejecting head 252*a* in the longitudinal direction, a center axis A2 extending along the X-axis through a center of the second liquid ejecting head 252*b* in the longitudinal direction, and a center axis A3 extending along the X-axis through a center of the third liquid ejecting head 252*c* in the longitudinal direction are located on the same straight line L1, as illustrated in FIG. 7.

The first liquid ejecting head 252*a* is a head selected in any desired way from the plurality of liquid ejecting heads 252, and the first gripping portion 40*a* is provided on an upper surface S1. The upper surface S1 is a surface in the Z1-direction on the Z-axis, and is a surface opposite to an ejecting surface of the liquid ejecting head 252. The first liquid ejecting head 252*a* has a first end portion E1 (first end portion) farthest away in the Y2-direction from the center of the first liquid ejecting head 252*a* in the longitudinal direction, and a second end portion E2 (second end portion) farthest away in the Y1-direction from the center. As illustrated in FIG. 7, the first gripping portion 40*a* is disposed between the first end portion E1 of the first liquid ejecting head 252*a* and the center axis A1.

The second liquid ejecting head 252*b* is provided in the X1-direction when viewed from the first liquid ejecting head 252*a*, and is adjacent to the first liquid ejecting head 252*a*. The second liquid ejecting head 252*b* is disposed in the X1-direction with respect to the first liquid ejecting head 252*a*. In addition, the second gripping portion 40*b* is provided on an upper surface S2 of the second liquid ejecting head 252*b*. The upper surface S2 is a surface in the Z1-direction on the Z-axis, and is a surface opposite to the ejecting surface of the liquid ejecting head 252. The second liquid ejecting head 252*b* has a second end portion E4 (fourth end portion) farthest away in the Y2-direction from the center of the second liquid ejecting head 252*b* in the longitudinal direction, and a first end portion E3 (third end portion) farthest away in the Y1-direction from the center. As illustrated in FIG. 7, the second gripping portion 40*b* is disposed between the first end portion E3 of the second liquid ejecting head 252*b* and the center axis A2.

Here, as illustrated in FIG. 7, the second end portion E4 of the second liquid ejecting head 252*b* is located in the Y2-direction when viewed from the first end portion E3 of the second liquid ejecting head 252*b*. That is, the first liquid ejecting head 252*a* and the second liquid ejecting head 252*b* have a relationship in which both of these are inverted from each other around the Z-axis. Specifically, when the first liquid ejecting head 252*a* rotates itself by 180° around the Z-axis, the first liquid ejecting head 252*a* is disposed in the same manner as the second liquid ejecting head 252*b*, and when the second liquid ejecting head 252*b* rotates itself by 180° around the Z-axis, the first liquid ejecting head 252*a* is disposed in the same manner as the first liquid ejecting head 252*a*.

A distance D1 between the first liquid ejecting head 252*a* and the second liquid ejecting head 252*b* in the X1-direction is narrower than a thickness of a human finger. Specifically, the distance D1 is narrower than a width D2 of the first gripping portion 40*a* in the X1-direction. For example, the distance D1 is preferably smaller than 15 mm, and is more preferably 10 mm or smaller. When the distance D1 is set to the above-described dimension, not only the head unit 250 can be downsized, but also a dense nozzle layout can be realized. In addition, even when the distance D1 is the above-described dimension, a user can put his or her finger in the distance between the first gripping portion 40*a* and the second gripping portion 40*b*. Therefore, there is no hindrance in gripping or replacing the first liquid ejecting head 252*a* or the second liquid ejecting head 252*b*. For example, the above-described user indicates an operator who replaces the liquid ejecting head 252. This point is the same in the following description.

For example, the distance D1 is a minimum distance in the X1-direction between a side surface 252S of the housing 31 of the main body portion 2521 of the first liquid ejecting head 252*a* and the side surface 252S of the housing 31 of the main body portion 2521 of the second liquid ejecting head 252*b*. For example, the minimum distance is a distance between the side surface 252S on the side in the X1-direction of the second portion U2 of the first liquid ejecting head 252*a* and the side surface 252S on the side in the X2-direction of the second portion U2 of the second liquid ejecting head 252*b*. In addition, the distance D3 between the first gripping portion 40*a* and the second gripping portion 40*b* illustrated in FIG. 8 is larger than the thickness of the human finger. For example, the distance D3 is larger than 15 mm.

The "thickness of the human finger" described above may be an average value of thicknesses of human fingers. For example, according to JP-A-2014-46555, the average value is set to 18 mm or smaller. Alternatively, the "thickness of the human finger" may be an average value of widths of adult fingers. For example, according to JP-A-2018-190268, the average value is set to substantially 15 mm to substantially 20 mm.

Alternatively, the "thickness of the human finger" described above may be an average value of widths of Japanese thumbs. For example, according to JP-A-2003-11943, the average value is set to 19.1 mm. Alternatively, the "thickness of the human finger" may be the thickness of an interphalangeal joint of a thumb of a Japanese male or the thickness of a joint width. For example, according to the following website, the thickness of the interphalangeal joint shows that the average value of 327 examinees is 17.3 mm and a maximum value is 20.1 mm. In addition, the average value of the joint width is 20.1 mm. (http://www.airc.aist-.go.jp/dhrt/hand/data/list.html) The above-described definition of the "thickness of the human finger" is the same in the following description.

Specifically, a distance D4 between a center axis A4 (first center axis) extending along the Y-axis through the center of the first gripping portion 40*a* in the X1-direction and a center axis A5 (second center axis) extending along the Y-axis through the center of the second gripping portion 40*b* in the X1-direction is smaller than 15 mm, for example. In addition, the maximum distance between the first gripping portion 40*a* and the second gripping portion 40*b* is 15 mm or larger, for example.

The third liquid ejecting head 252*c* is provided in the X1-direction when viewed from the second liquid ejecting head 252*b*, and is adjacent to the second liquid ejecting head 252*b*. The third liquid ejecting head 252*c* is disposed in the X1-direction with respect to the second liquid ejecting head 252*b*. In addition, a third gripping portion 40*c* is provided on an upper surface S3 of the third liquid ejecting head 252*c*. The upper surface S3 is a surface in the Z1-direction on the Z-axis, and is a surface opposite to the ejecting surface of the liquid ejecting head 252. The third liquid ejecting head 252*c* has a first end portion E5 (fifth end portion) farthest away in the Y2-direction from the center of the third liquid ejecting head 252*c* in the longitudinal direction, and a second end portion E6 (sixth end portion) farthest away in the Y1-direction from the center. As illustrated in FIG. 7, the third gripping portion 40*c* is disposed between the first end portion E5 of the third liquid ejecting head 252*c* and the center axis A3.

The second liquid ejecting head 252*b* and the third liquid ejecting head 252*c* have a relationship in which both of these are inverted from each other around the Z-axis. That is, when the second liquid ejecting head 252*b* rotates itself by 180° around the Z-axis, the second liquid ejecting head 252*b* is disposed in the same manner as the third liquid ejecting head 252*c*, and when the third liquid ejecting head 252*c* rotates itself by 180° around the Z-axis, the third liquid ejecting head 252*c* is disposed in the same manner as the second liquid ejecting head 252*b*.

In the present embodiment, as illustrated in FIG. 7, in the direction along the Y-axis, a direction oriented from the first end portion E1 of the first liquid ejecting head 252*a* toward the second end portion E2 is the same as a direction oriented from the first end portion E5 of the third liquid ejecting head 252*c* toward the second end portion E6, and is opposite to a direction oriented from the first end portion E3 of the second liquid ejecting head 252*b* toward the second end portion E4. That is, in a state where the head unit 250 is held by the holding member 251, the second liquid ejecting head 252*b* is disposed to be inverted by 180° around the Z-axis with respect to the first liquid ejecting head 252*a*, and the third liquid ejecting head is disposed. 252*c* is disposed to be inverted by 180° around the Z-axis with respect to the second liquid ejecting head 252*b*.

In this manner, even when structures of the respective heads 252 adjacent to each other are not changed, a distance between the respective gripping portions 40 of the heads 252 adjacent to each other is widened only by disposing the heads 252 to be inverted. Therefore, a user more easily grips the gripping portion without burdening the cost of changing the structure of the liquid ejecting head 252.

A distance D5 between the second liquid ejecting head 252*b* and the third liquid ejecting head 252*c* in the X1-direction is narrower than the thickness of the human finger. Specifically, the distance D5 is narrower than the width D2 of the first gripping portion 40*a*. For example, the distance D5 is preferably smaller than 15 mm, and is more preferably 10 mm or smaller. When the distance D5 is set to the above-described dimension, not only the head unit 250 can be downsized, but also a dense nozzle layout can be realized. In addition, even if the distance D5 is the above-described dimension, a user can put his or her finger in the distance between the second gripping portion 40*b* and the third gripping portion 40*c*. Therefore, there is no hindrance in gripping or replacing the second liquid ejecting head 252*b* or the third liquid ejecting head 252*c*.

For example, the distance D5 is the minimum distance in the X1-direction between the side surface 252S of the housing 31 of the main body portion 2521 of the second liquid ejecting head 252*b* and the side surface 252S of the housing 31 of the main body portion 2521 of the third liquid ejecting head 252*c*. For example, the minimum distance is a distance between the side surface 252S on the side in the X1-direction of the second portion U2 of the second liquid ejecting head 252*b* and the side surface 252S on the side in the X2-direction of the second portion U2 of the third liquid ejecting head 252*c*. In addition, a distance D6 between the second gripping portion 40*b* and the third gripping portion 40*c* illustrated in FIG. 8 is larger than the thickness of the human finger, and is larger than 15 mm, for example. Here, in the present embodiment, the distance D1 and the distance D5 are narrower than the width D2 of the gripping portion 40. In this manner, even when a gap between the heads 252 adjacent to each other is narrower than the width of the gripping portion 40, positions of the gripping portions 40 of the heads 252 adjacent to each other in the Y2-direction are different from each other. Therefore, the distance between the respective gripping portions 40 is secured to some extent. Therefore, a user can easily grip the gripping portion.

A distance D7 between the center axis A5 and the center axis A6 (third center axis) extending along the Y-axis through the center of the third gripping portion 40*c* in the X1-direction is smaller than 15 mm, for example. In addition, the maximum distance between the second gripping portion 40*b* and the third gripping portion 40*c* is 15 mm or larger, for example.

In the present embodiment, the maximum distance between the first gripping portion 40*a* and the second gripping portion 40*b*, and the maximum distance between the second gripping portion 40*b* and the third gripping portion 40*c* are equal to or larger than the thickness of the human finger, and is 15 mm or larger, for example. In this manner, a finger can be inserted into a gap between the gripping portions 40 of the heads 252 adjacent to each other. Therefore, a user more easily replaces the head. In particular, when the thickness of the finger is the thickness of the human thumb, the user can use the thumb to replace the head. Therefore, the user much more easily replaces the head.

Here, as illustrated in FIGS. 12 to 16, when the gripping portion 40 has shapes illustrated in Application Example 9 to Application Example 11 (to be described later), a distance between the second portion 44 of the first gripping portion 40*a* and the second portion 44 of the second gripping portion 40*b* may be the maximum distance between the first gripping portion 40*a* and the second gripping portion 40*b*. Similarly, a distance between the second portion 44 of the second gripping portion 40*b* and the second portion 44 of the third gripping portion 40*c* may be the maximum distance between the second gripping portion 40*b* and the third gripping portion 40*c*.

As illustrated in FIG. 7, the first gripping portion 40*a* and the third gripping portion 40*c* are disposed at the same position in the Y2-direction. Specifically, the first gripping portion 40*a* and the third gripping portion 40*c* are located on the mutually same straight line L2.

More specifically, a center axis A7 extending along the X-axis through the center of the first gripping portion 40*a* in the Y2-direction and a center axis A8 extending along the X-axis through the center of the third gripping portion 40*c* in the Y2-direction are located on the same straight line L2. In addition, a distance D8 between the first gripping portion 40*a* and the third gripping portion 40*c* in the X1-direction illustrated in FIG. 8 is larger than the thickness of the human finger, and is larger than 15 mm, for example.

Here, a position of the second gripping portion 40*b* in the Y2-direction according to the present embodiment is different from positions of the first gripping portion 40*a* and the third gripping portion 40*c* in the Y2-direction. Typically, as illustrated in FIG. 7, when viewed in the X1-direction, the second gripping portion 40*b* is disposed at a position which does not overlap the first gripping portion 40*a* and the third gripping portion 40*c*. In this manner, the positions of the respective gripping portions 40 provided in the adjacent liquid ejecting head 252 in the Y2-direction are different from each other. Therefore, the distance between the gripping portions 40 is widened, and a user can easily grip the gripping portions 40. In particular, as illustrated in FIG. 7, in a case where the second gripping portion 40*b* is disposed at the position which does not overlap the first gripping portion 40*a* and the third gripping portion 40*c* when viewed in the X1-direction, compared to a case where both of these overlap each other, the distance between the respective gripping portions 40 is widened, and the gripping portion 40 is more easily gripped.

Specifically, the second gripping portion 40*b* is not located on the same straight line L2 as that of the first gripping portion 40*a* and the third gripping portion 40*c*. More specifically, a center axis A9 extending along the X-axis through the center of the second gripping portion 40*b* in the Y2-direction, and the center axis A7 and the center axis A8 are not located on the same straight line L2.

As illustrated in FIG. 7, the first liquid ejecting head 252*a*, the fourth liquid ejecting head 252*d*, and the fifth liquid ejecting head 252*e* are disposed at the same position in the X1-direction. Specifically, the first liquid ejecting head 252*a*, the fourth liquid ejecting head 252*d*, and the fifth liquid ejecting head 252*e* are located on the same straight line L3. More specifically, the center axis A4 extending along the Y-axis through the center of the first liquid ejecting head 252*a* in the short direction, a center axis A10 extending along the Y-axis through the center of the fourth liquid ejecting head 252*d* in the short direction, a center axis A11 extending along the Y-axis through the center of the fifth liquid ejecting head 252*e* in the short direction are located on the same straight line L3.

The fourth liquid ejecting head 252*d* is provided in the Y1-direction when viewed from the first liquid ejecting head 252*a*, and is adjacent to the first liquid ejecting head 252*a* in the Y1-direction. The fourth liquid ejecting head 252*d* is disposed in the Y1-direction with respect to the first liquid ejecting head 252*a*. In addition, a fourth gripping portion 40*d* is provided on an upper surface S4 of the fourth liquid ejecting head 252*d*. The upper surface S4 is a surface in the Z1-direction on the Z-axis, and is a surface opposite to the ejecting surface of the liquid ejecting head 252. The fourth liquid ejecting head 252*d* has a first end portion E7 (seventh end portion) farthest away in the Y2-direction from the center of the fourth liquid ejecting head 252*d* in the longitudinal direction, and a second end portion E8 (eighth end portion) farthest away in the Y1-direction from the center. As illustrated in FIG. 7, the fourth gripping portion 40*d* is disposed between the first end portion E7 and a center axis A12 extending along the X-axis through the center of the fourth liquid ejecting head 252*d* in the longitudinal direction. The first liquid ejecting head 252*a* and the fourth liquid ejecting head 252*d* have an arrangement relationship different from an arrangement relationship between the first liquid ejecting head 252*a* and the second liquid ejecting head 252*b* and an arrangement relationship between the second liquid ejecting head 252*b* and the third liquid ejecting head 252*c*, and have the mutually same arrangement relationship without being disposed in the same manner when both of these are inverted around the Z-axis. The same arrangement relationship indicates a state where a direction (Y2-direction) oriented from the center of the first liquid ejecting head 252*a* in the longitudinal direction toward the first gripping portion 40*a* and a direction (Y2-direction) oriented from the center of the fourth liquid ejecting head 252*d* in the longitudinal direction toward the fourth gripping portion 40*d* are the same as each other.

A distance D9 between the first liquid ejecting head 252*a* and the fourth liquid ejecting head 252*d* in the Y2-direction is narrower than the thickness of the human finger. For example, the distance D9 is preferably 15 mm or smaller, and is more preferably 10 mm or smaller. When the distance D9 is set to the above-described dimension, not only the head unit 250 can be downsized, but also a dense nozzle layout can be realized. In addition, even when the distance D9 is the above-described dimension, a user can put his or her finger in the distance between the first gripping portion 40*a* and the fourth gripping portion 40*d*. Therefore, there is no hindrance in gripping or replacing the first liquid ejecting head 252*a* or the fourth liquid ejecting head 252*d*.

For example, the distance D9 is the minimum distance in the Y2-direction between the side surface 252S of the housing 31 of the main body portion 2521 of the first liquid ejecting head 252*a* and the side surface 252S of the housing 31 of the main body portion 2521 of the fourth liquid ejecting head 252*d*. For example, the minimum distance is a distance between the side surface 252S on the side in the Y1-direction of the first portion U1 of the first liquid ejecting head 252*a* and the side surface 252S on the side in the Y2-direction of the second portion U2 of the fourth liquid ejecting head 252*d*. In addition, as illustrated in FIG. 8, a distance D10 between the first gripping portion 40*a* and the fourth gripping portion 40*d* in the Y2-direction is larger than the thickness of the human finger, and is larger than 15 mm, for example. Furthermore, as illustrated in FIG. 8, a distance D11 between the second gripping portion 40*b* and the fourth gripping portion 40*d* is also larger than the thickness of the human finger, and is larger than 15 mm, for example.

The fifth liquid ejecting head 252*e* is provided in the Y1-direction when viewed from the fourth liquid ejecting head 252*d*, and is adjacent to the fourth liquid ejecting head 252*d* in the Y1-direction. The fifth liquid ejecting head 252*e* is disposed in the Y1-direction with respect to the fourth liquid ejecting head 252*d*. In addition, a fifth gripping portion 40*e* is provided on an upper surface S5 of the fifth liquid ejecting head 252*e*. The upper surface S5 is a surface in the Z1-direction on the Z-axis, and is a surface opposite to the ejecting surface of the liquid ejecting head 252. The fifth liquid ejecting head 252*e* has a first end portion E9 (ninth end portion) farthest away in the Y2-direction from the center of the fifth liquid ejecting head 252*e* in the longitudinal direction and a second end portion E10 (tenth end portion) farthest away in the Y1-direction from the center. As illustrated in FIG. 7, the fifth gripping portion 40*e* is disposed between the first end portion E9 and a center axis A13 extending along the X-axis through the center of the fifth liquid ejecting head 252*e* in the longitudinal direction.

Here, as illustrated in FIG. 7, in the direction along the Y-axis, a direction oriented from the first end portion E1 of the first liquid ejecting head 252*a* toward the second end portion E2 is the same as a direction oriented from the first end portion E7 of the fourth liquid ejecting head 252*d* toward the second end portion E8 and a direction oriented from the first end portion E9 of the fifth liquid ejecting head 252*e* toward the second end portion E10. In other words, a direction (Y2-direction) oriented from the center of the first liquid ejecting head 252*a* in the longitudinal direction toward the first gripping portion 40*a* is the same as a direction (Y2-direction) oriented from the center of the fourth liquid ejecting head 252*d* in the longitudinal direction toward the fourth gripping portion 40*d*, and a direction (Y2-direction) oriented from the center of the fifth liquid ejecting head 252*e* in the longitudinal direction toward the fifth gripping portion 40*e*. That is, in a state where the head unit 250 is held by the holding member 251, the first liquid ejecting head 252*a*, the fourth liquid ejecting head 252*d*, and the fifth liquid ejecting head 252*e* have the same arrangement relationship. In this manner, the heads 252 adjacent to each other in the Y2-direction are disposed to face the same direction. Therefore, the distance between the respective gripping portions 40 is widened, and a user can easily grip the gripping portions 40.

A distance D12 between the fourth liquid ejecting head 252*d* and the fifth liquid ejecting head 252*e* in the Y2-direction is narrower than the thickness of the human finger. For example, the distance D12 is preferably 15 mm or smaller, and is more preferably 10 mm or smaller. When the distance D12 is set to the above-described dimension, not only the head unit 250 can be downsized, but also a dense nozzle layout can be realized. In addition, even when the distance D12 is the above-described dimension, a user can put his or her finger in the distance between the fourth gripping portion 40*d* and the fifth gripping portion 40*e*. Therefore, there is no hindrance in gripping or replacing the fourth liquid ejecting head 252*d* or the fifth liquid ejecting head 252*e*.

For example, the distance D12 is the minimum distance in the Y2-direction between the side surface 252S of the housing 31 of the main body portion 2521 of the fourth liquid ejecting head 252*d* and the side surface 252S of the housing 31 of the main body portion 2521 of the fifth liquid ejecting head 252*e*. For example, the minimum distance is a distance between the side surface 252S on the side in the Y1-direction of the first portion U1 of the fourth liquid ejecting head 252*d* and the side surface 252S on the side in the Y2-direction of the second portion U2 of the fifth liquid ejecting head 252*e*. In addition, as illustrated in FIG. 8, a distance D13 between the fourth gripping portion 40*d* and the fifth gripping portion 40*e* in the Y2-direction is larger than the thickness of the human finger, and is larger than 15 mm, for example.

In the present embodiment, the first liquid ejecting head 252*a*, the second liquid ejecting head 252*b*, and the third liquid ejecting head 252*c* have the same structure. Therefore, a distance DX1 between the center axis A1 and the first gripping portion 40*a* in the Y2-direction, a distance DX2 between the center axis A2 and the second gripping portion 40*b* in the Y2-direction, and a distance DX3 between the center axis A3 and the third gripping portion 40*c* in the Y2-direction are typically the same as each other. Similarly, the first liquid ejecting head 252*a*, the fourth liquid ejecting head 252*d*, and the fifth liquid ejecting head 252*e* have the same structure. Therefore, the distance DX1 between the center axis A1 and the first gripping portion 40*a* in the Y2-direction, a distance DX4 between the center axis A12 and the fourth gripping portion 40*d* in the Y2-direction, and a distance DX5 between the center axis A13 and the fifth gripping portion 40*e* in the Y2-direction are the same as each other.

Application Example 2

Figure 9:
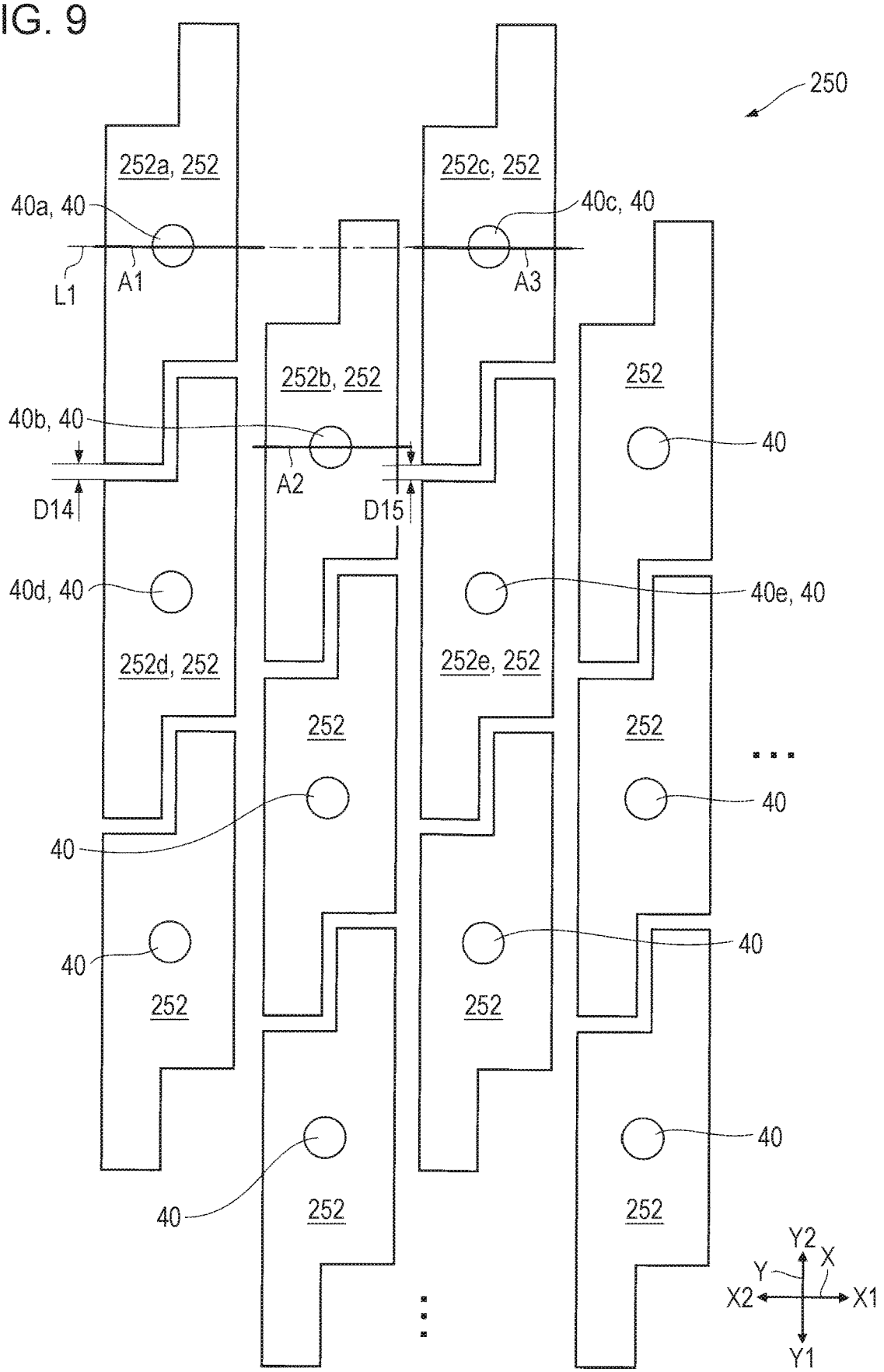
FIG. 9 is a schematic view illustrating an example of an array of the liquid ejecting heads.

FIG. 9 is a schematic view illustrating an example of an array of the liquid ejecting heads 252. In the present embodiment, as illustrated in FIG. 9, the first liquid ejecting head 252*a* and the third liquid ejecting head 252*c* may be disposed at the same position in the Y2-direction, and the second liquid ejecting head 252*b* may be disposed at a position different from that of the first liquid ejecting head 252*a* and the third liquid ejecting head 252*c* in the Y2-direction. In this manner, even when the first liquid ejecting head 252*a*, the second liquid ejecting head 252*b*, and the third liquid ejecting head 252*c* have the same structure, the first gripping portion 40*a* and the second gripping portion 40*b*, and the second gripping portion 40*b* and the third gripping portion 40*c* are disposed at different positions in the Y2-direction. Therefore, the distance between the respective gripping portions 40 of the heads 252 adjacent to each other is widened, and a user more easily grips the gripping portion.

Specifically, the first liquid ejecting head 252*a* and the third liquid ejecting head 252*c* may be located on the mutually same straight line L1, and the second liquid ejecting head 252*b* may not be located on the same straight line L1. More specifically, the center axis A1 of the first liquid ejecting head 252*a* and the center axis A3 of the third liquid ejecting head 252*c* may be located on the same straight line L1, and the center axis A2 of the second liquid ejecting head 252*b* may not be located on the same straight line L2.

In addition, as illustrated in FIG. 9, the fourth liquid ejecting head 252*d* may be adjacent to the first liquid ejecting head 252*a* in the Y2-direction, and may be adjacent to the second liquid ejecting head 252*b* in the X1-direction. A distance D14 between the first liquid ejecting head 252*a* and the fourth liquid ejecting head 252*d* is narrower than the thickness of the human finger. For example, the distance D13 is preferably 15 mm or smaller, and is more preferably 10 mm or smaller. When the distance D14 is set to the above-described dimension, not only the head unit 250 can be downsized, but also a dense nozzle layout can be realized. In addition, even when the distance D14 is the above-described dimension, a user can put his or her finger in the distance between the first gripping portion 40*a* and the fourth gripping portion 40*d*. Therefore, there is no hindrance in gripping or replacing the first liquid ejecting head 252*a* or the fourth liquid ejecting head 252*d*.

For example, the distance D14 is the minimum distance in the Y2-direction between the side surface 252S of the housing 31 of the main body portion 2521 of the first liquid ejecting head 252*a* and the side surface 252S of the housing 31 of the main body portion 2521 of the fourth liquid ejecting head 252*d*. For example, the minimum distance is a distance between the side surface 252S on the side in the Y1-direction of the first portion U1 of the first liquid ejecting head 252*a* and the side surface 252S on the side in the Y2-direction of the second portion U2 of the fourth liquid ejecting head 252*d*.

Furthermore, as illustrated in FIG. 9, the fifth liquid ejecting head 252*e* may be adjacent to the third liquid ejecting head 252*c* in the Y2-direction, and may be adjacent to the second liquid ejecting head 252*b* in the X2-direction. A distance D15 between the fifth liquid ejecting head 252*e* and the third liquid ejecting head 252*c* is narrower than the thickness of the human finger. For example, the distance D15 is preferably 15 mm or smaller, and is more preferably 10 mm or smaller. When the distance D15 is set to the above-described dimension, not only the head unit 250 can be downsized, but also a dense nozzle layout can be realized. In addition, even when the distance D15 is the size described above, a user can put his or her finger in the distance between the third gripping portion 40*c* and the fifth gripping portion 40*e*. Therefore, there is no hindrance in gripping or replacing the third liquid ejecting head 252*c* or the fifth liquid ejecting head 252*e*.

For example, the distance D15 is the minimum distance in the Y2-direction between the side surface 252S of the housing 31 of the main body portion 2521 of the third liquid ejecting head 252*c* and the side surface 252S of the housing 31 of the main body portion 2521 of the fifth liquid ejecting head 252*e*. For example, the minimum distance is a distance between the side surface 252S on the side in the Y1-direction of the first portion U1 of the third liquid ejecting head 252*c* and the side surface 252S on the side in the Y2-direction of the second portion U2 of the fifth liquid ejecting head 252*e*.

As illustrated in FIG. 2, when three or more liquid ejecting heads 252 are disposed in the longitudinal direction and three or more liquid ejecting heads 252 are disposed in the short direction, that is, when the plurality of liquid ejecting heads 252 are disposed in a matrix, the side surface of the liquid ejecting head 252 disposed in the center is surrounded by the adjacent liquid ejecting head. Therefore, in order to replace the liquid ejecting head 252 disposed in the center, a knob needs to be provided on the upper surface S of the liquid ejecting head 252. In addition, when the knob is provided on the side surface of the liquid ejecting head 252, a size of the liquid ejecting head 252 increases in a horizontal direction, or the liquid ejecting heads 252 cannot be disposed at a high density. Therefore, the knob needs to be provided on the upper surface S of the liquid ejecting head 252. Furthermore, in reducing a size of the holding member 251 (for example, a carriage), when a gap between an inner wall surface of the holding member 251 and the liquid ejecting head 252 is narrow, even if the plurality of liquid ejecting heads 252 are not disposed in a matrix, the knob cannot be provided on the side surface of the liquid ejecting head 252. Therefore, even in this case, the knob needs to be provided on the upper surface S of the liquid ejecting head 252.

In view of the above-described circumstances, as illustrated in FIG. 5, the liquid ejecting head 252 according to the present embodiment has the gripping portion 40 provided on the upper surface S facing the Z1-direction of the cover portion 2522*e*. The upper surface S is a surface in the Z1-direction on the Z-axis, and is a surface opposite to the ejecting surface of the liquid ejecting head 252. A user can easily move the liquid ejecting head 252 by gripping and pulling the gripping portion 40.

For example, when the liquid ejecting head 252 fails, the gripping portion 40 functions as a knob for attaching and detaching the liquid ejecting head 252 to and from the holding member 251.

For example, a height h of the gripping portion 40 is 18 mm or larger. A width w of the gripping portion 40 is smaller than a width of the liquid ejecting head 252 in the Y2-direction, and is from 20 mm to 50 mm, for example. The gripping portion 40 may be configured to be integrated with the cover portion 2522*e*, or may be configured separately. In addition, the gripping portion 40 may be formed of a material the same as that of the cover portion 2522*e*, or may be formed of a different material.

In addition, the gripping portion 40 may be provided on the upper surface of the housing 31 of the liquid ejecting head 252. In this case, the gripping portion 40 may be configured to be integrated with the housing 31, or may be configured separately. In addition, the gripping portion 40 may be formed of a material the same as that of the housing 31, or may be formed of a different material. The upper surface is a surface in the Z1-direction on the Z-axis of the housing 31, and is a surface opposite to the ejecting surface of the liquid ejecting head 252.

Figure 10:
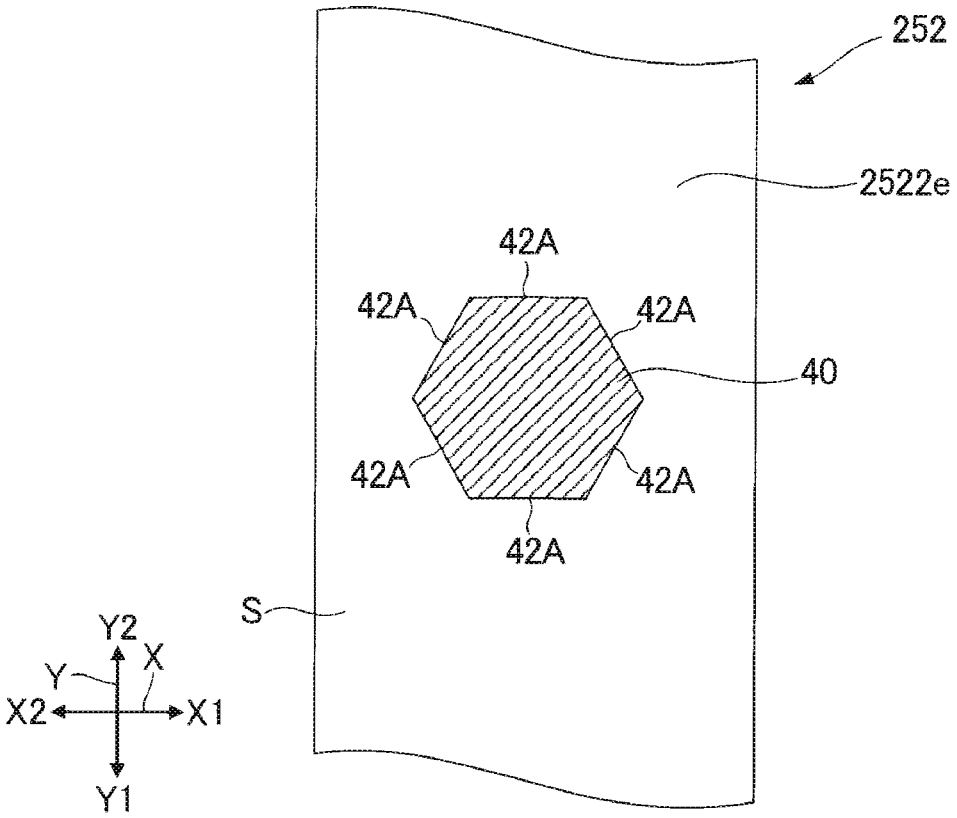
FIG. 10 is a cross-sectional view taken along line X-X in FIG. 5.

FIG. 10 is a cross-sectional view taken along line X-X in FIG. 5. The gripping portion 40 is typically a regular hexagonal column, and a cross-sectional shape perpendicular to the Z-axis is a regular hexagon including six linear sides 42A. However, any other desired shape may be adopted. Hereinafter, some shapes that can be adopted by the gripping portion 40 according to the present embodiment will be described.

Application Example 3

In FIG. 10, the cross-sectional shape perpendicular to the X-axis of the gripping portion 40 is the regular hexagon including the six linear sides 42A. However, a polygon including at least four linear sides 42A may be adopted. In this manner, a user can grip the gripping portion 40 regardless of its own orientation with respect to the liquid ejecting head 252. The cross-sectional shape perpendicular to the X-axis of the gripping portion 40 may be a polygon in which one of the linear sides 42A has a different length, and is not limited to the regular polygon.

Application Example 4

Figure 11A:
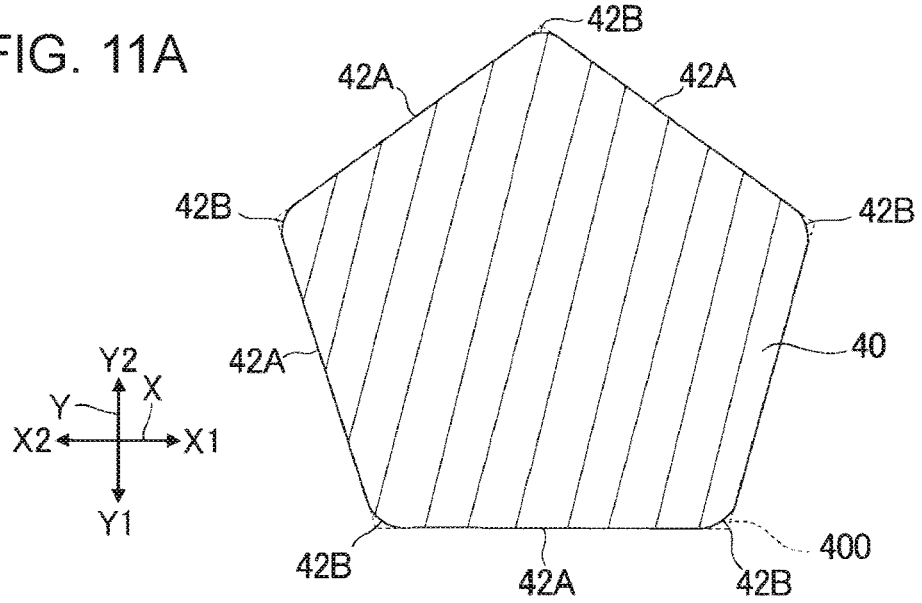
FIG. 11A is a schematic view illustrating an example of a cross-sectional shape that can be adopted by a gripping portion.

FIG. 11A is a schematic view illustrating an example of a cross-sectional shape that can be adopted by the gripping portion 40. As illustrated in FIG. 11A, the cross-sectional shape perpendicular to the Z-axis of the gripping portion 40 has a substantially polygonal shape having an R-shaped portion 42B in a corner of a polygon 400 including at least four or more linear sides. Specifically, the approximate polygon in FIG. 11A includes five linear sides 42A and five R-shaped portions 42B provided between the five linear sides 42A. The R-shaped portion 42B may be provided in at least one corner of the polygon 400. Even according to this configuration, as in Application Example 3, a user can grip the gripping portion 40 regardless of his or her orientation with respect to the liquid ejecting head 252. In the present embodiment, an aspect exemplified in Application Example 4 may be appropriately combined with an aspect exemplified in Application Example 5 or Application Example 6 (to be described later) within a scope where both of these do not contradict each other.

Application Example 5

Figure 11B:
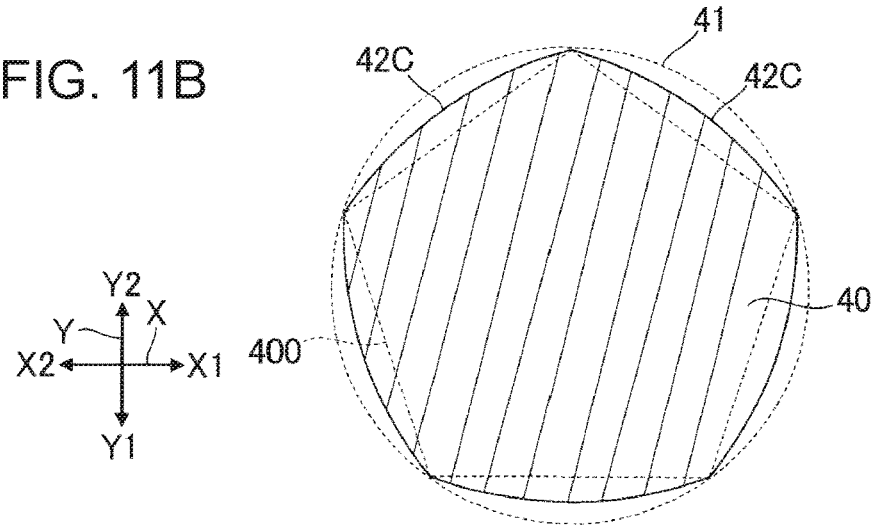
FIG. 11B is a schematic view illustrating an example of a cross-sectional shape that can be adopted by the gripping portion.

FIG. 11B is a schematic view illustrating an example of a cross-sectional shape that can be adopted by the gripping portion 40. As illustrated in FIG. 11B, the cross-sectional shape perpendicular to the Z-axis of the gripping portion 40 has a substantially polygonal shape in which each side of the polygon 400 including at least four or more linear sides is a curve 42C. As illustrated in the drawing, the curve 42C swells in a direction away from the center (center of the gripping portion 40) of the cross section of the polygon 400, and is a curve located radially inward of a circumscribed circle 41 when the polygon 400 is the regular polygon. Even according to this configuration, as in Application Example 3, a user can grip the gripping portion 40 regardless of his or her orientation with respect to the liquid ejecting head 252.

Application Example 6

Figure 11C:
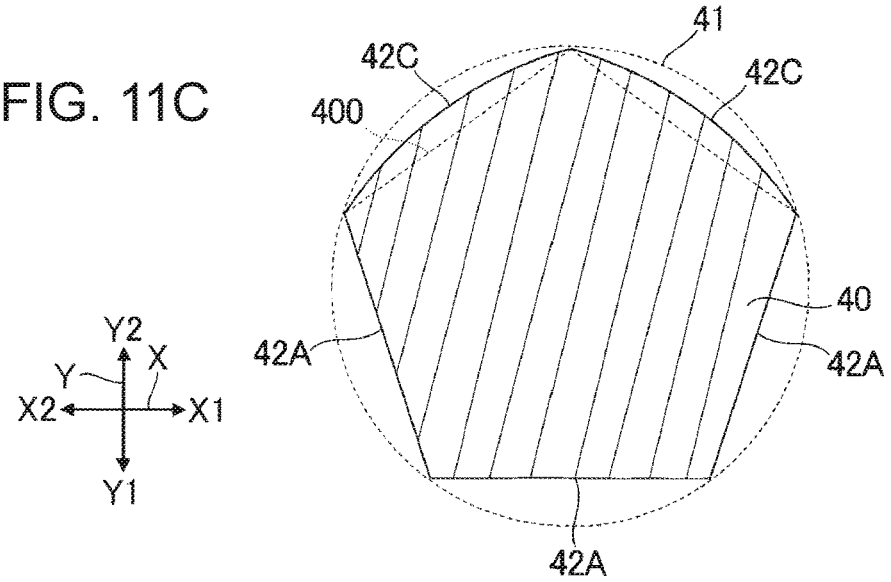
FIG. 11C is a schematic view illustrating an example of a cross-sectional shape that can be adopted by the gripping portion.

FIG. 11C is a schematic view illustrating an example of a cross-sectional shape that can be adopted by the gripping portion 40. As illustrated in FIG. 11C, the cross-sectional shape perpendicular to the Z-axis of the gripping portion 40 has a substantially polygonal shape in which at least one or more sides of the polygon 400 including at least four or more linear sides are the curves 42C. As illustrated in FIG. 11C, the approximate polygon includes two curves 42C and three linear sides 42A. As illustrated in the drawing, the curve 42C swells in a direction away from the center (center of the gripping portion 40) of the cross section of the polygon 400. When the polygon 400 is the regular polygon, the curve 42C may be a portion of the circumscribed circle 41 circumscribed in the polygon 400, and may be a curve located radially inward of the circumscribed circle 41. The above-described approximate polygon is not a perfect circle. Accordingly, when the curve 42C is a portion of the circumscribed circle 41, at least one or more linear sides 42A are included in the approximate polygon. Even according to this configuration, as in Application Example 3, a user can grip the gripping portion 40 regardless of his or her orientation with respect to the liquid ejecting head 252.

A length of the linear side 42A in Application Example 3 to Application Example 6 is preferably from 1.0 cm to 2.0 cm, and is more preferably 1.5 cm. When the length of the linear side 42A is 1 cm or longer, the length of the side is substantially the same as the thickness of the human finger. Accordingly, a user can easily grip the gripping portion 40.

Similarly, the length of the curve 42C in Application Example 5 and Application Example 6 is preferably from 1.0 cm to 2.0 cm, and is more preferably 1.5 cm. When the length of the curve 42C is 1 cm or longer, the length of the side is substantially the same as the thickness of the human finger. Accordingly, a user can easily grip the gripping portion 40.

Application Example 7

The cross-sectional shape of the gripping portion 40 in the X1-direction may be a shape including five or six linear sides 42A. In this manner, a user can grip the gripping portion in every direction, compared to a case where the cross-sectional shape of the gripping portion 40 is a quadrangle. Furthermore, when the cross-sectional shape of the gripping portion 40 is the shape including five or six linear sides 42A, the length of one side of the cross-sectional shape can be prevented from being shortened, compared to a case where the cross-sectional shape of the gripping portion 40 is a heptagon. That is, there is no possibility that the gripping portion 40 may be less likely to be gripped due to a size increased to secure the length of one side of the cross-sectional shape of the gripping portion 40. Therefore, a user can grip the gripping portion in every direction without increasing the size of the gripping portion 40.

Application Example 8

The cross-sectional shape of the gripping portion 40 in the X1-direction may include a total of 5 or 6 linear sides 42A and curves 42C. In this manner, as in Application Example 7, a user can grip the gripping portion in every direction without increasing the size of the gripping portion 40.

Application Example 9

Figure 12:
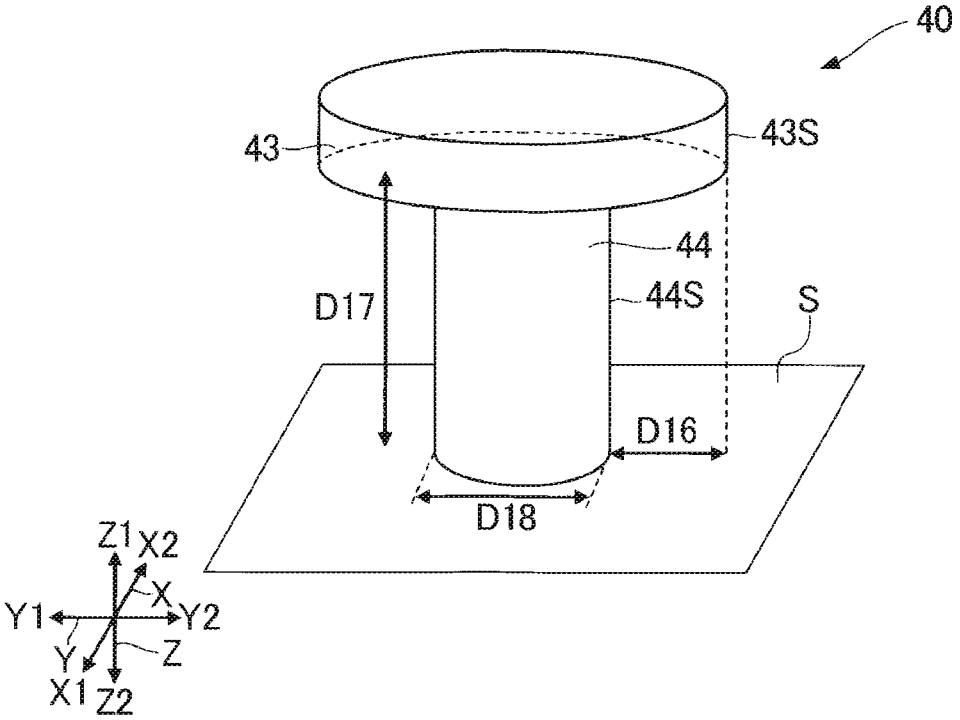
FIG. 12 is a schematic view illustrating an example of a shape that can be adopted by the gripping portion.
Figure 13:
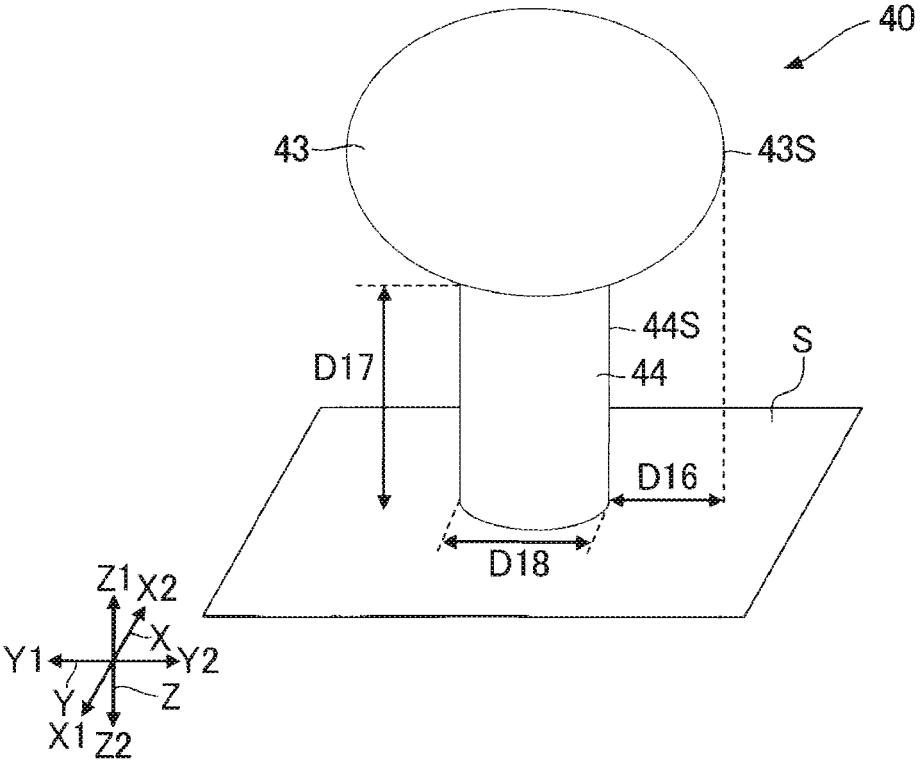
FIG. 13 is a schematic view illustrating an example of a shape that can be adopted by the gripping portion.
Figure 14:
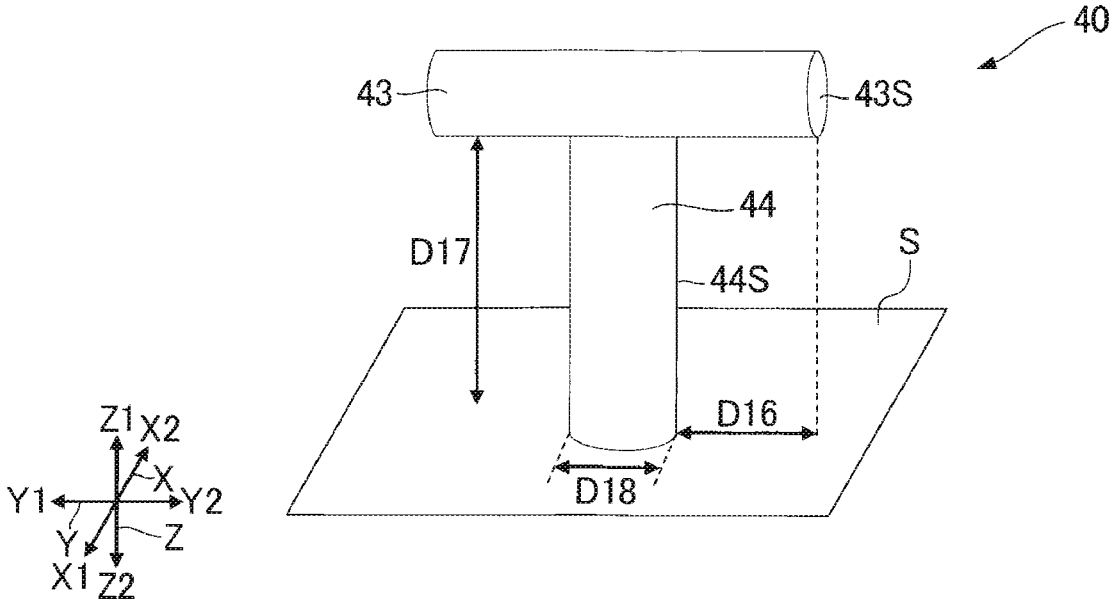
FIG. 14 is a schematic view illustrating an example of a shape that can be adopted by the gripping portion.

FIGS. 12 to 14 are schematic views illustrating an example of a shape that can be adopted by the gripping portion 40. The gripping portion 40 may be configured to have the first portion 43 and the second portion 44. The first portion 43 has a side surface 43S (second side surface) that faces a direction perpendicular to the Z-axis. The side surface 43S may be a continuous curved surface, or may be a planar surface. A distance between the side surface 43S and the second portion 44 in the direction perpendicular to the Z-axis, specifically, a distance D16 between the side surface 43S and the second portion 44 in the Y2-direction is 15 mm or larger, for example.

A maximum width of the first portion 43 in the direction perpendicular to the Z-axis is larger than a maximum width of the second portion 44 in the direction perpendicular to the Z-axis. Specifically, the maximum width of the first portion 43 in the Y2-direction is larger than the maximum width of the second portion 44 in the Y2-direction. The shape of the first portion 43 is not particularly limited, and for example, may be a disc shape or a spherical shape. The shape is not particularly limited.

The second portion 44 is located between the first portion 43 and the upper surface S, and is provided on the upper surface S. The second portion 44 has the side surface 44S (first side surface) around the Z-axis. The side surface 44S may be a continuous curved surface, or may be a planar surface.

The first portion 43 protrudes in the direction perpendicular to the Z-axis from the side surface 44S of the second portion 44. In FIGS. 12 and 13, the first portion 43 has a portion protruding from an entire periphery of the side surface 44S of the second portion 44 when viewed in the direction along the Z-axis. Specifically, the first portion 43 protrudes in the Y2-direction from the side surface 44S of the second portion 44. A dimension D18 of the second portion 44 in the Y2-direction is 15 mm or larger, for example. In addition, a dimension D17 of the second portion 44 in the Z2-direction is 15 mm or larger, for example.

Figure 16:
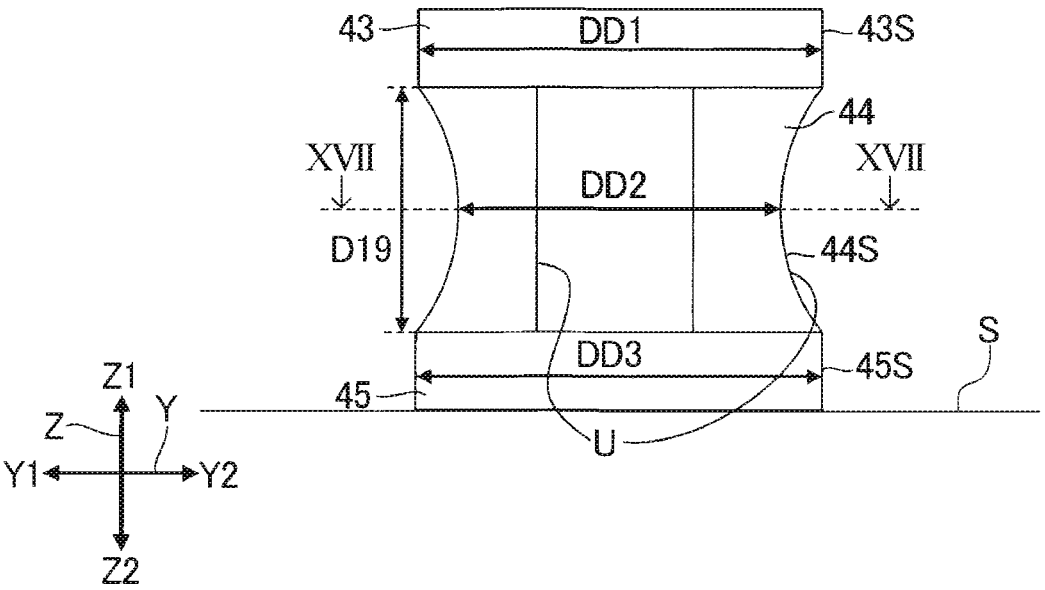
FIG. 16 is a schematic view illustrating an example of a shape that can be adopted by the gripping portion.
Figure 17:
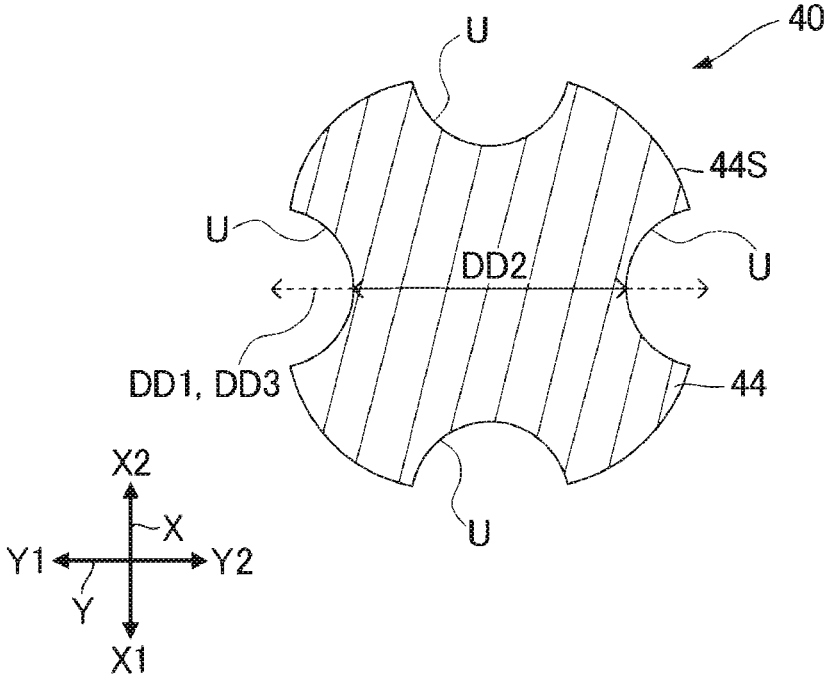
FIG. 17 is a schematic view illustrating an example of a shape that can be adopted by the gripping portion.

The shape of the second portion 44 is not particularly limited, and for example, may be a cube, a sphere, or a structure in which curved recess portions are continuously or intermittently formed around one axis as illustrated in FIGS. 16 and 17. However, the type is not particularly limited.

As described above, the gripping portion 40 in Application Example 9 has the first portion 43 and the second portion 44. As illustrated in FIGS. 12 to 14, the first portion 43 protrudes in the Y2-direction from the side surface 44S of the second portion 44. In addition, the maximum width of the first portion 43 in the Y2-direction is larger than the maximum width of the second portion 44 in the Y2-direction.

In this manner, a user easily catches the first portion 43 on his or her finger when gripping the second portion 44. Therefore, this configuration reduces a risk that the liquid ejecting head 252 may slip off from the user's hand. Furthermore, the user can lift the liquid ejecting head 252 by catching the gripping portion 40 on an inner surface or a side surface of the finger. Accordingly, a user more easily replaces the head.

Application Example 10

Figure 15:
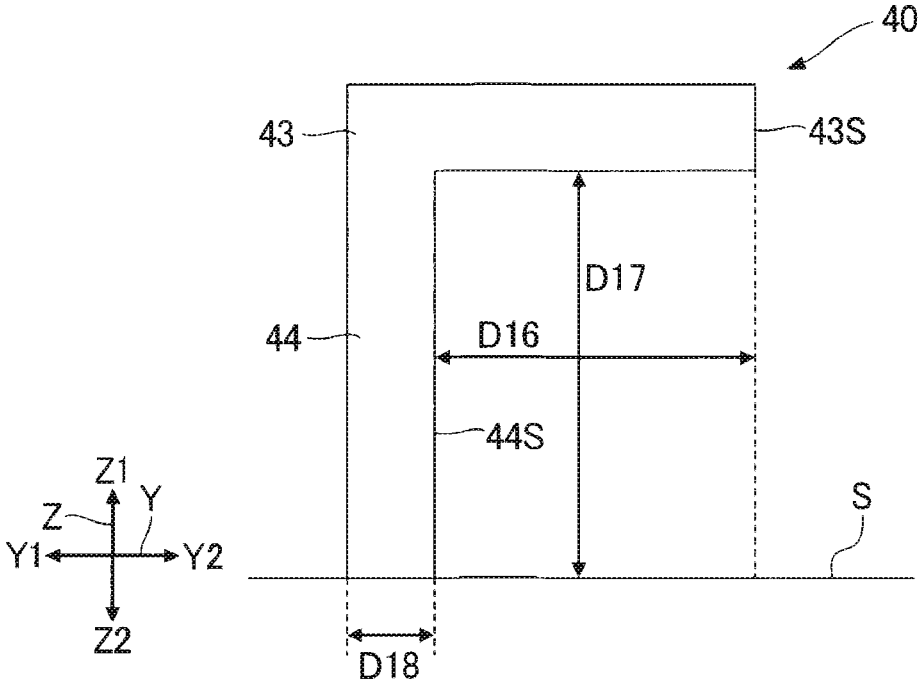
FIG. 15 is a schematic view illustrating an example of a shape that can be adopted by the gripping portion.

FIG. 15 is a schematic view illustrating an example of a shape that can be adopted by the gripping portion 40. The gripping portion 40 may be configured to have the first portion 43 and the second portion 44. As illustrated in FIG. 15, the first portion 43 in Application Example 10 is a columnar body in which the direction along the Y-axis is the longitudinal direction, and the second portion 44 is a columnar body in which the direction along the Z-axis is the longitudinal direction.

The first portion 43 has the side surface 43S (second side surface) facing the Y2-direction. The side surface 43S may be a continuous curved surface, or may be a planar surface. The distance D16 between the side surface 43S and the second portion 44 in the Y2-direction is 15 mm or larger, for example. The maximum width of the first portion 43 in the Y2-direction is larger than the maximum width of the second portion 44 in the Y2-direction.

The second portion 44 is located between the first portion 43 and the upper surface S, and is provided on the upper surface S. The second portion 44 has the side surface 44S (first side surface) around the Z-axis. The side surface 44S may be a continuous curved surface, or may be a planar surface.

The first portion 43 protrudes in the Y2-direction from the side surface 44S of the second portion 44. A dimension D18 of the second portion 44 in the Y2-direction is 15 mm or larger, for example. In addition, a dimension D17 of the second portion 44 in the Z2-direction is 15 mm or larger, for example.

As described above, the gripping portion 40 in Application Example 10 has the first portion 43 and the second portion 44. As illustrated in FIG. 15, the first portion 43 protrudes in the Y2-direction from the side surface 44S of the second portion 44. In addition, the maximum width of the first portion 43 in the Y2-direction is larger than the maximum width of the second portion 44 in the Y2-direction. In this manner, the same operational effect as those of Application Example 9 can be obtained.

Application Example 11

FIG. 16 is a schematic view illustrating an example of a shape that can be adopted by the gripping portion 40. FIG. 17 is a cross-sectional view taken along line XVII-XVII in FIG. 16. As illustrated in FIG. 16, the gripping portion 40 may be configured to further have a third portion 45 in addition to the first portion 43 and the second portion 44. The third portion 45 is located between the second portion 44 and the upper surface S, and is provided on the upper surface S.

The third portion 45 has the side surface 45S around the Z-axis. The side surface 45S may be a continuous curved surface, or may be a planar surface. The maximum width of the third portion 45 in the direction perpendicular to the Z-axis is larger than or equal to the width of the second portion 44 in the direction perpendicular to the Z-axis. Specifically, the maximum width of the third portion 45 in the Y2-direction is larger than or equal to the width of the second portion 44 in the Y2-direction. In other words, the width of the second portion 44 in the Y2-direction is smaller than or equal to the width of the third portion 45 in the Y2-direction. In the present embodiment, the maximum width of the second portion 44 in the direction perpendicular to the Z-axis corresponds to a boundary portion between the first portion 43 and the second portion 44 and a boundary portion between the second portion 44 and the third portion 45. Therefore, the maximum width of the third portion 45 in the direction perpendicular to the Z-axis is the same as the maximum width of the first portion 43 and the second portion 44 in the direction perpendicular to the Z-axis. Specifically, as illustrated in FIG. 16, the maximum width of the third portion 45 in the Y2-direction is the same as the maximum width of the first portion 43 and the second portion 44 in the Y2-direction.

A shortest distance D19 between the first portion 43 and the third portion 45 in the Z2-direction is 15 mm or larger, for example. The shape of the third portion 45 is not particularly limited, and may be a disc shape or a spherical shape. The shape is not particularly limited. In addition, the third portion 45 may have a configuration the same as that of the first portion 43, or may have a different configuration.

As illustrated in FIG. 17, when the gripping portion 40 has the third portion 45, the second portion 44 may be provided with recess portions U intermittently formed around the Z-axis as illustrated in FIG. 17. The second portion 44 may be a curved surface as the recess portion U continuous around the Z-axis. For example, the recess portion U may be formed toward a radial center of the second portion 44. The cross-sectional shape of the recess portion U in the Y2-direction is not limited to a semicircular shape as illustrated in FIG. 17, and any shape such as a triangular shape, a rectangular shape, a polygonal shape, a semi-elliptical shape, or a combined shape thereof may be adopted. The type is not particularly limited.

As illustrated in FIGS. 16 and 17, the second portion 44 has a width DD2 in the direction perpendicular to the Z-axis between the boundary portion between the first portion 43 and the second portion 44 and the boundary portion between the second portion 44 and the third portion 45 in the X1-direction. The width DD2 of the second portion 44 is narrower than a maximum width DD1 of the first portion 43 in the direction perpendicular to the Z-axis and a maximum width DD3 of the third portion 45 in the direction perpendicular to the Z-axis. In this way, the gripping portion 40 has a constricted shape. Accordingly, the gripping portion 40 is easily gripped.

Application Example 12

Figure 18:
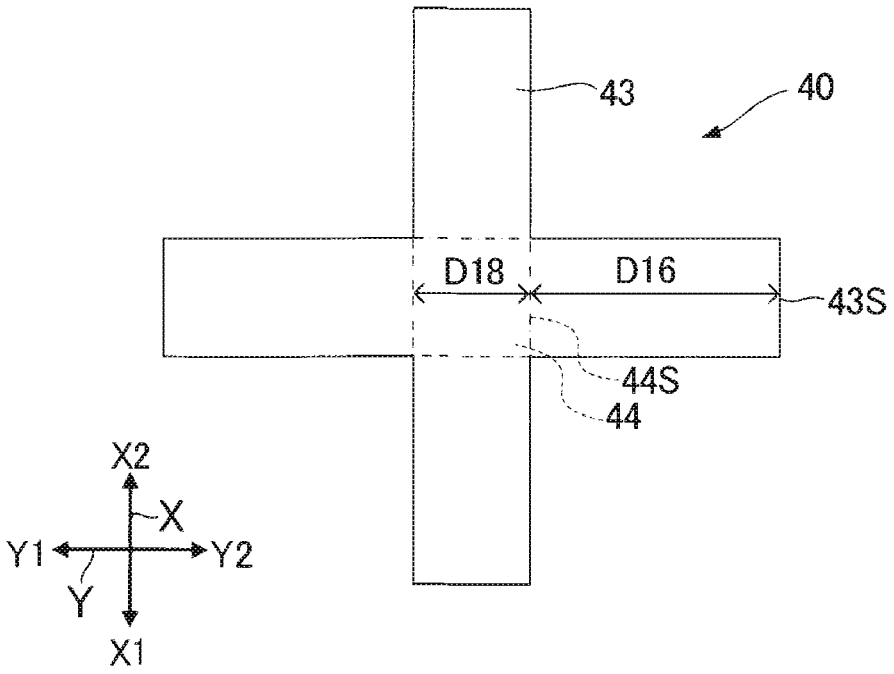
FIG. 18 is a schematic view illustrating an example of a shape that can be adopted by the gripping portion.

FIG. 18 is a schematic view illustrating an example of a shape that can be adopted by the gripping portion 40, and is a plan view when the gripping portion 40 is viewed in the Z1-direction. The gripping portion 40 may have a cross shape when viewed in the Z1-direction of the first portion 43. In this case, the dimension of the second portion 44 in the Z2-direction (not illustrated) may be 15 mm or larger, for example. In addition, the distance D16 between the side surface 43S of the first portion 43 and the second portion 44 in the direction orthogonal to the Z-axis may be 15 mm or larger, for example.

Application Example 13

Figure 19:
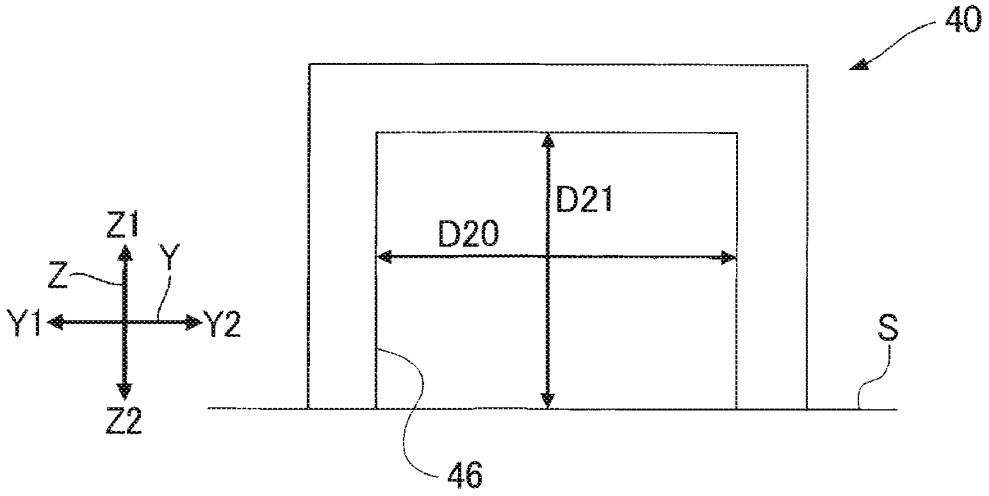
FIG. 19 is a schematic view illustrating an example of a shape that can be adopted by the gripping portion.
Figure 20:
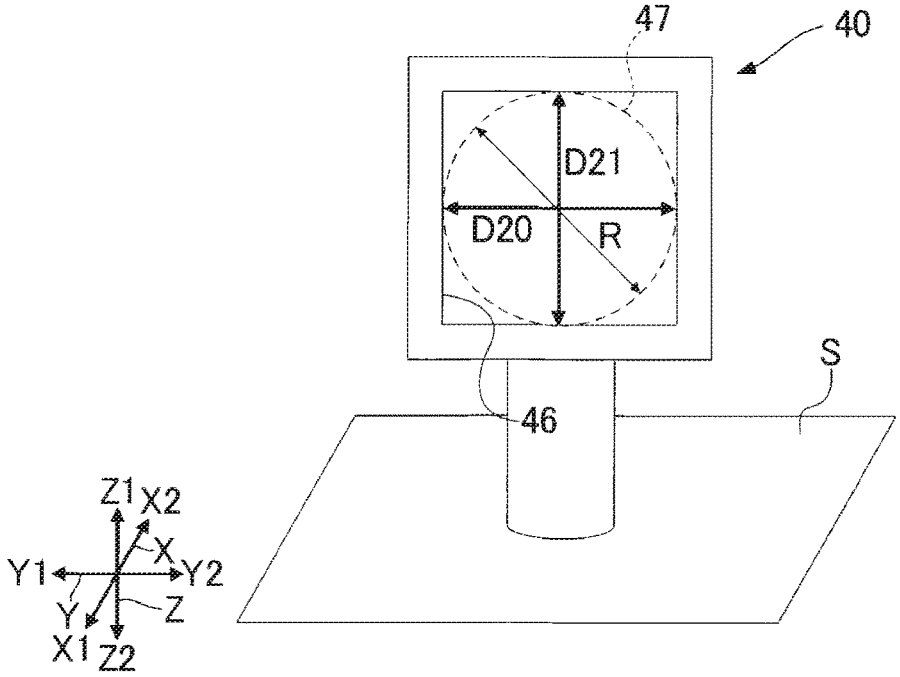
FIG. 20 is a schematic view illustrating an example of a shape that can be adopted by the gripping portion.

FIGS. 19 and 20 are schematic views illustrating an example of a shape that can be adopted by the gripping portion 40. As illustrated in FIGS. 19 and 20, the gripping portion 40 may be configured to have an opening 46. The opening 46 may be open in the Z2-direction, or may be an annular opening. When the opening 46 is the annular opening as illustrated in FIG. 20, a diameter R of an inscribed circle 47 inscribed in the opening 46 is 15 mm or larger, for example.

A size (horizontal width D20 and vertical width D21) of the opening 46 is not particularly limited as long as a user's finger can pass through the size. In addition, the shape of the opening 46 is not particularly limited, and may be any type such as a circular shape, an elliptical shape, a triangular shape, a rectangular shape, or a polygonal shape. The type is not particularly limited. In addition, a shape in which a cutout portion is provided in a portion of a frame body that defines the opening 46 of the gripping portion 40 may be used.

As described above, the gripping portion 40 in Application Example 13 has the opening 46, and the diameter R of the inscribed circle 47 inscribed in the opening 46 is 15 mm or larger. In this manner, a user can pass his or her finger through the opening 46 of the gripping portion 40. Therefore, a user more safely replaces the liquid ejecting head 252.

Application Example 14

Figure 21:
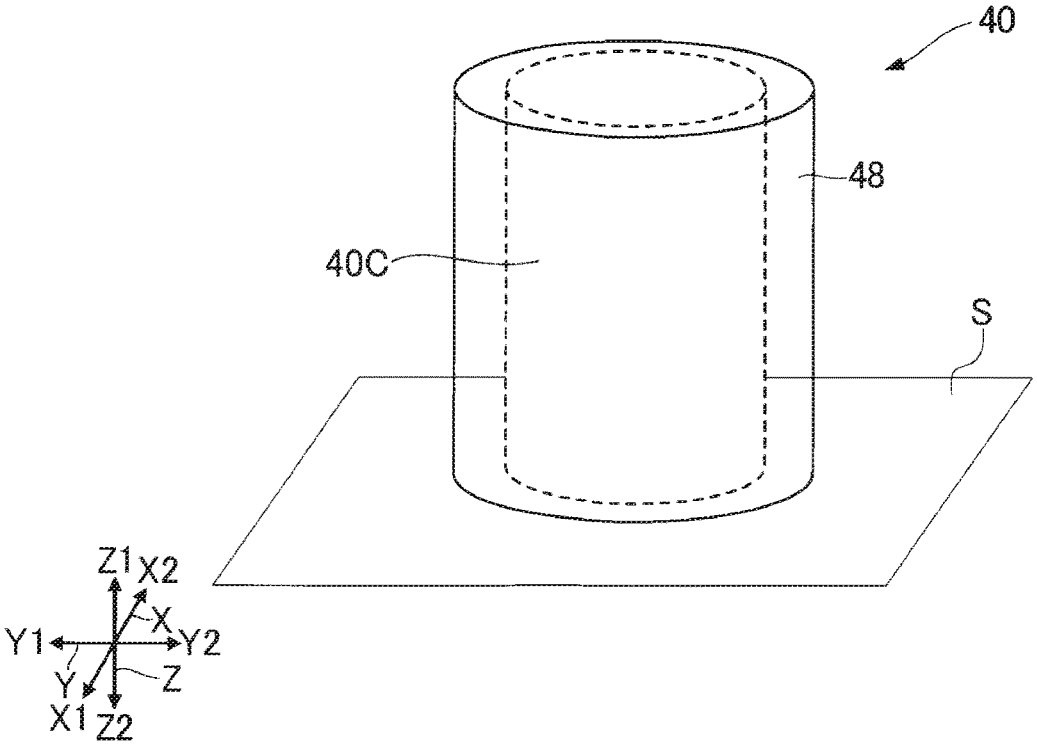
FIG. 21 is a schematic view illustrating an example of a shape that can be adopted by the gripping portion.

FIG. 21 is a schematic view illustrating an example of a shape that can be adopted by the gripping portion 40. The gripping portion 40 may have a higher coefficient of static friction than the side surface 252S around the Z-axis of the liquid ejecting head 252 illustrated in FIG. 3. In this manner, a user's finger is less likely to slip on the gripping portion 40. Accordingly, the user can stably grip the gripping portion 40. Therefore, a user more stably replaces the liquid ejecting head 252.

When the gripping portion 40 has the higher coefficient of static friction than the side surface 252S, as illustrated in FIG. 21, a portion of the gripping portion 40 may be an elastic body 48, or the whole gripping portion 40 may be the elastic body 48. For example, the elastic body 48 is formed of a material having tackiness such as an elastomer (thermosetting or thermoplastic elastomer). In addition, as illustrated in FIG. 21, when a portion of the gripping portion 40 is the elastic body 48 so that a central portion 40C of the gripping portion 40 is covered with the elastic body 48, for example, the elastic body 48 is preferably a resin film containing olefin resin, and is more preferably a resin film containing propylene resin or ethylene resin. For example, the tackiness described above means a sticky feeling (adhesive feeling) created on the surface of the gripping portion 40.

Application Example 15

Figure 22:
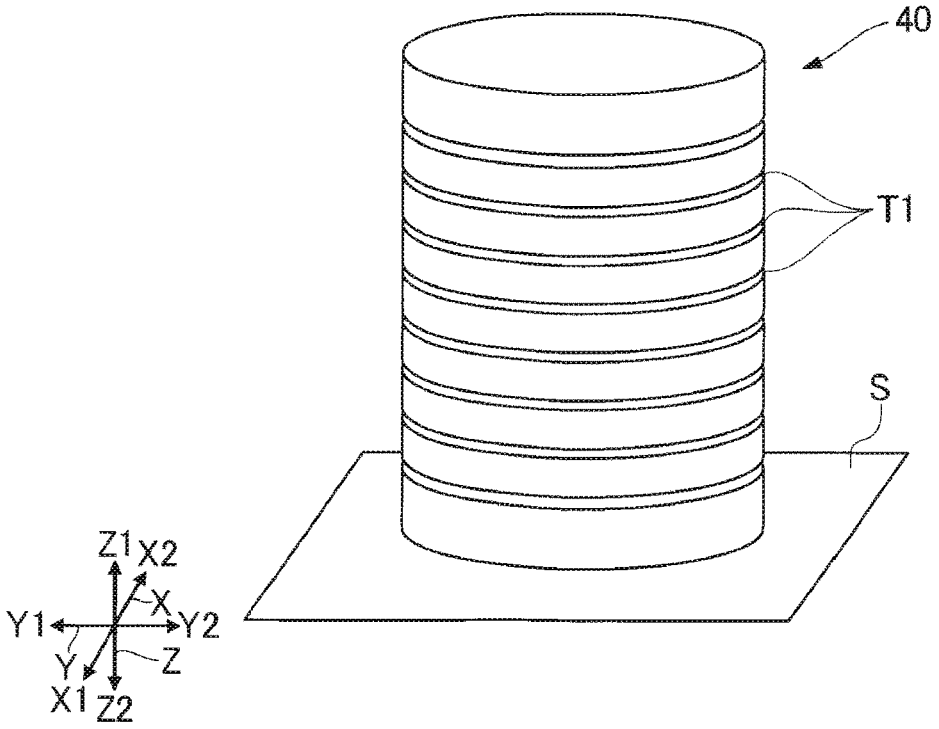
FIG. 22 is a schematic view illustrating an example of a shape that can be adopted by the gripping portion.
Figure 23:
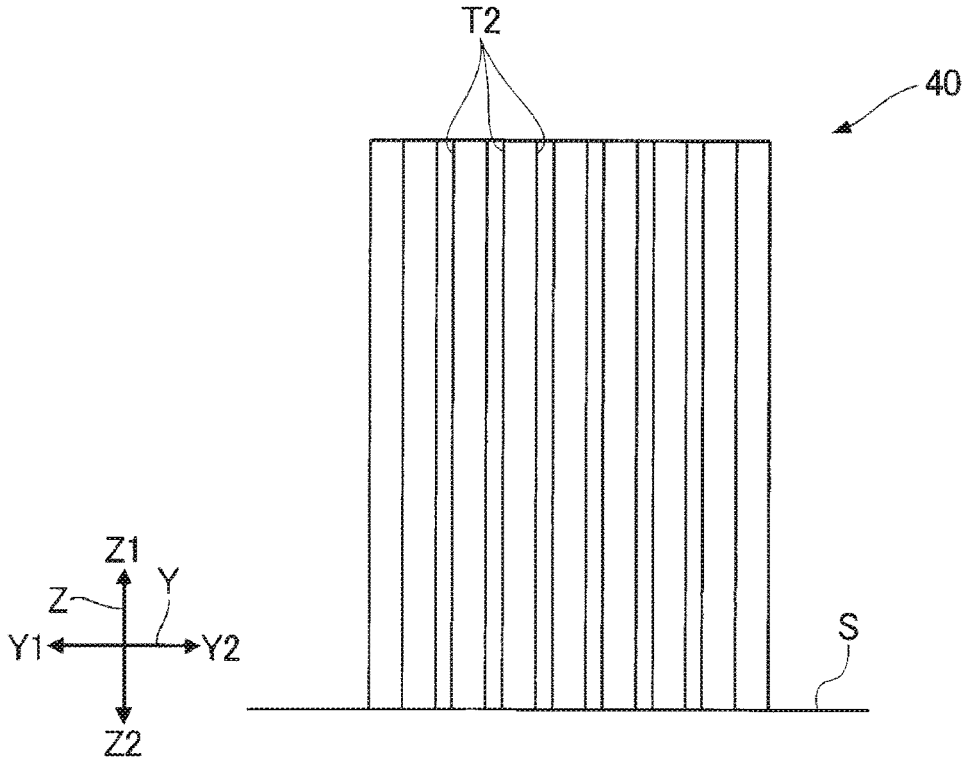
FIG. 23 is a schematic view illustrating an example of a shape that can be adopted by the gripping portion.

FIGS. 22 and 23 are schematic views illustrating an example of a shape that can be adopted by the gripping portion 40. The gripping portion 40 may have a shape having a groove T1. As illustrated in FIG. 22, the groove T1 may be provided around the Z-axis, and a plurality of the grooves T1 may be provided along the Z2-direction. In this manner, a user's finger is less likely to slip on the gripping portion 40. Accordingly, the user can stably grip the gripping portion 40. Therefore, a user more stably replaces the liquid ejecting head 252. When the grooves T1 are provided in the gripping portion 40, the grooves T1 may be continuously formed around the Z-axis, or may be intermittently formed.

In addition, the gripping portion 40 may have a shape having a groove T2. As illustrated in FIG. 23, the groove T2 is provided along the Z1-direction, and a plurality of the grooves T2 may be provided around the Z-axis. In this manner, the same operational effect as described above can be obtained. When the grooves T2 are provided in the gripping portion 40, the grooves T2 may be continuously formed along the Z1-direction, or may be intermittently formed.

Application Example 16

Figure 24:
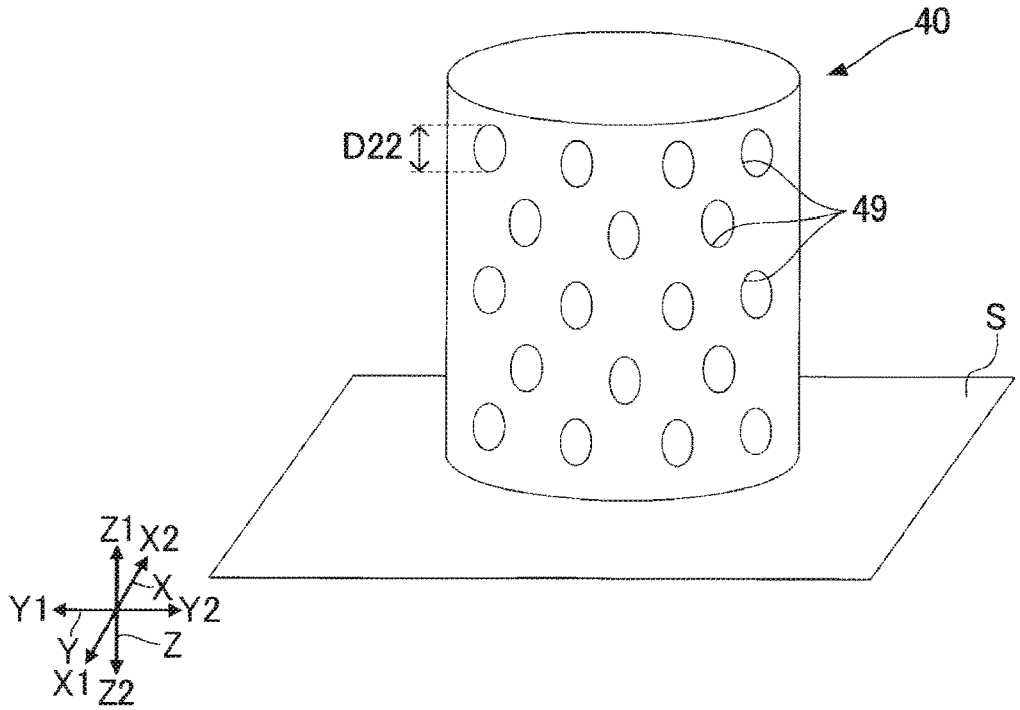
FIG. 24 is a schematic view illustrating an example of a shape that can be adopted by the gripping portion.

FIG. 24 is a schematic view illustrating an example of a shape that can be adopted by the gripping portion 40. As illustrated in FIG. 24, the gripping portion 40 may have a shape having a plurality of recess portions 49. In this manner, the same operational effect as described above can be obtained. For example, the plurality of recess portions 49 are configured to include a dimple-shaped recess portion. When the plurality of recess portions 49 are formed in the gripping portion 40, a diameter D22 of the recess portions 49 is from 3 mm to 5 mm, for example.

Application Example 17

The gripping portion 40 may be configured to be pivotable around the Z-axis. In this manner, a user can grip the gripping portion 40 without depending on the user's own orientation with respect to the liquid ejecting head 252. When the gripping portion 40 is configured to be pivotable around the Z-axis, a shape of the gripping portion 40 may be a shape illustrated in FIGS. 2 and 10, and the shape of Application Example 3 to Application Example 16 described above may be selected in any desired way. In addition, when the gripping portion 40 is configured to be pivotable around the Z-axis, the shape of the gripping portion 40 may be a combined shape within the scope where two or more configurations selected in any desired way from Application Examples illustrated in FIGS. 2 and 10 and Application Examples 3 to 16 do not contradict each other.

B: Modification Example

Hitherto, the embodiments according to the present disclosure have been described. However, the present disclosure is not limited to the above-described embodiments, and various modifications can be additionally made. Aspects of specific modifications that can be assigned to the above-described aspects will be described below as examples. Two or more aspects selected in any desired way from the following examples may be appropriately combined with each other as long as the aspects do not contradict each other.

Figure 25:
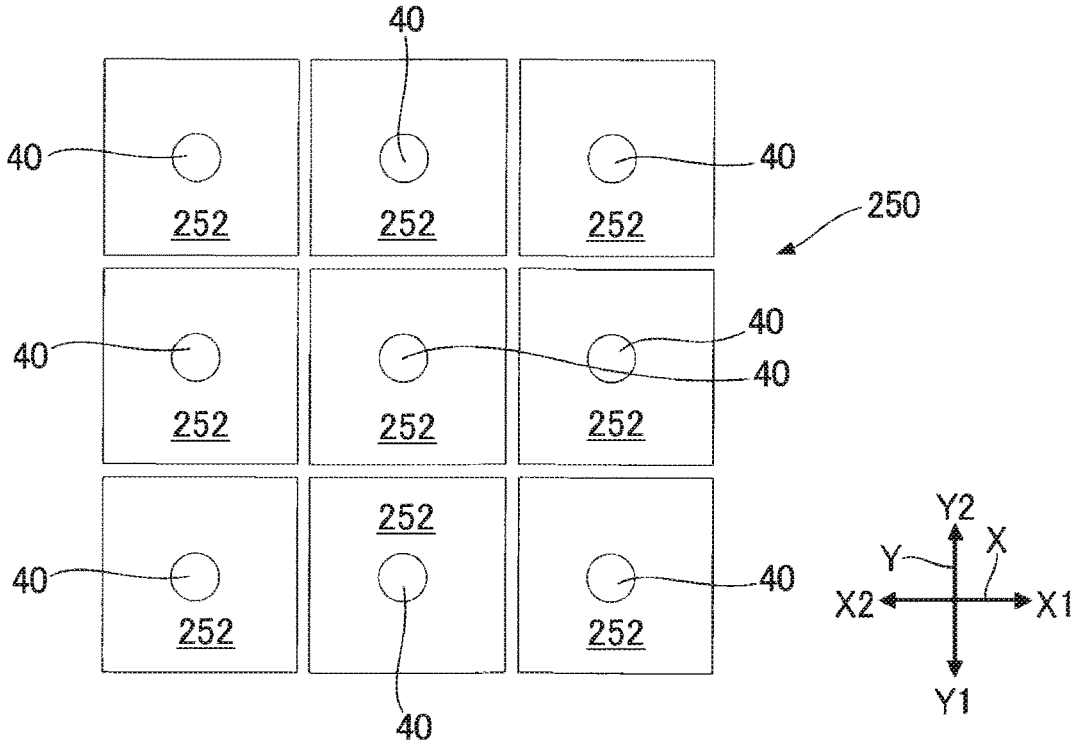
FIG. 25 is a schematic view illustrating an example of an array of liquid ejecting heads according to a modification example.

(1) FIG. 25 is a schematic view illustrating an example of an array of the liquid ejecting heads 252 in a modification example. The liquid ejecting head 252 is not limited to the shape illustrated in FIG. 2, and may have a square shape when viewed in the Z1-direction, for example. When the shape of the liquid ejecting head 252 viewed in the Z1-direction is the square shape, as illustrated in FIG. 25, the liquid ejecting heads 252 are disposed with an equal distance in a matrix in the holding member 251.

Figure 26:
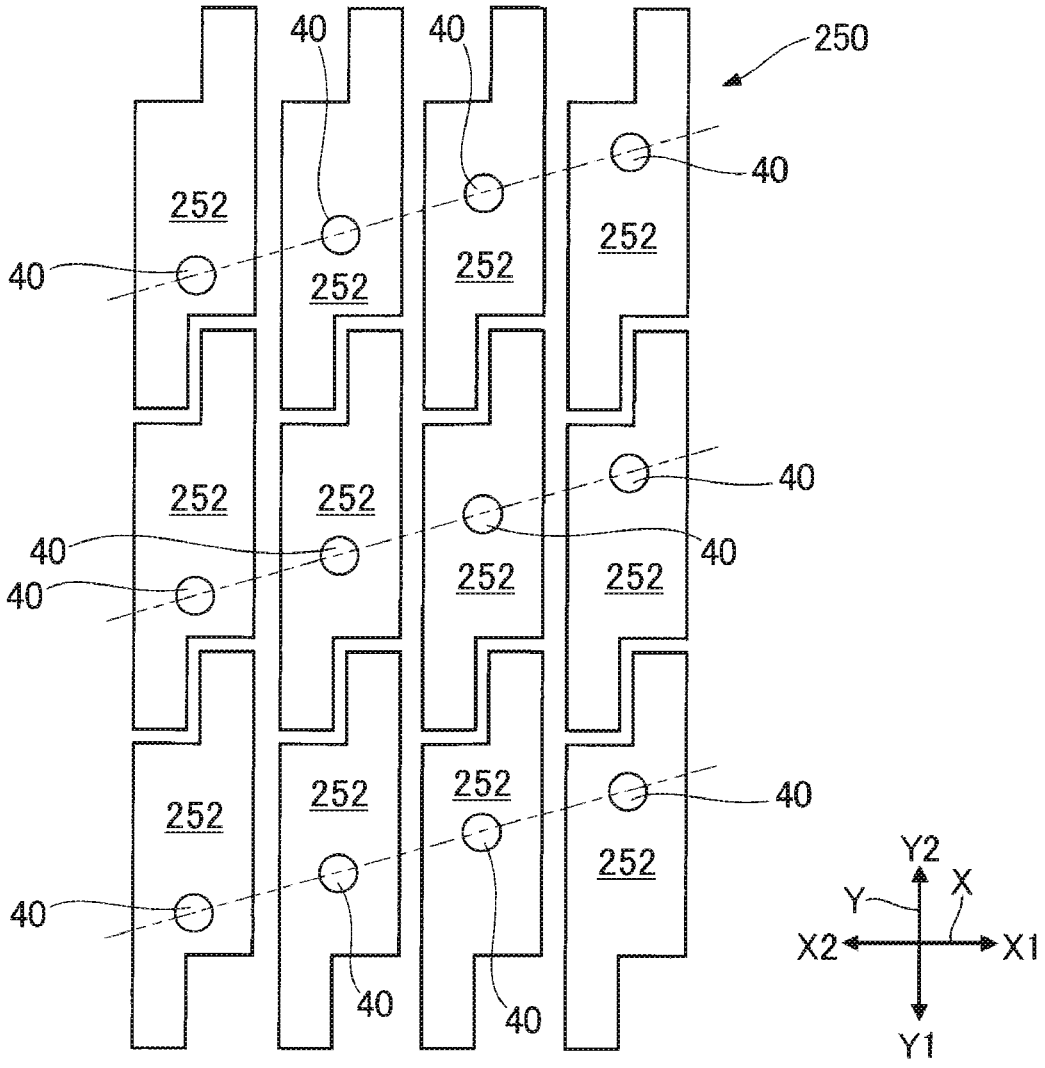
FIG. 26 is a schematic view illustrating an example of an array of a gripping portion according to a modification example.

(2) FIG. 26 is a schematic view illustrating an example of an array of the gripping portions 40 in a modification example. The plurality of gripping portions 40 may be respectively disposed with an equal distance along a direction that forms a predetermined angle from the Y-axis direction toward the X-axis direction.

Figure 27:
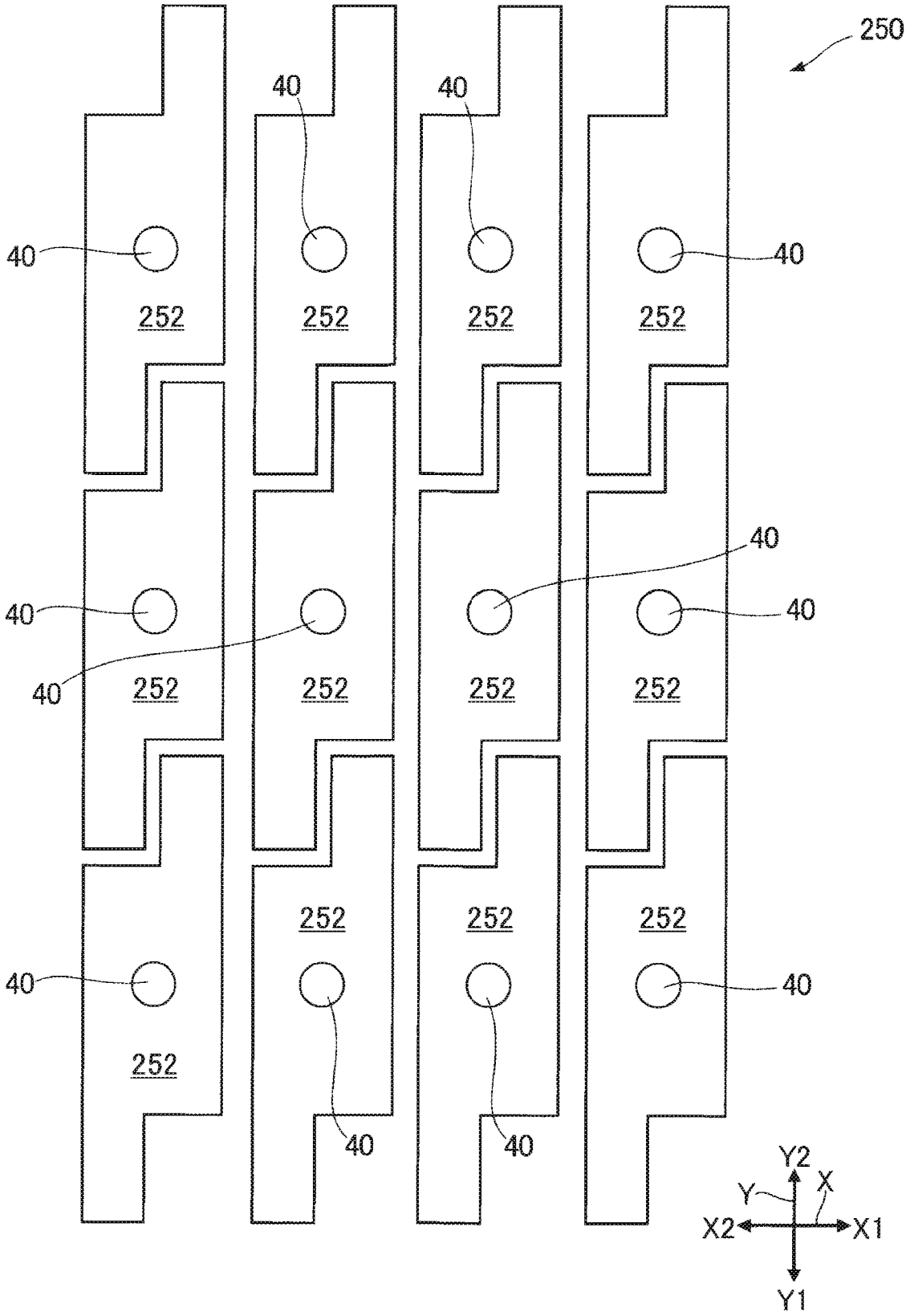
FIG. 27 is a schematic view illustrating an example of an array of liquid ejecting heads according to a modification example.

(3) FIG. 27 is a schematic view illustrating an example of an array of the liquid ejecting heads 252 in a modification example. As illustrated in FIG. 27, the plurality of liquid ejecting heads 252 may be respectively disposed at the same position in the X1-direction and the Y2-direction. Here, as illustrated in the drawing, the plurality of gripping portions 40 may be respectively disposed at the same position in the X1-direction and the Y2-direction.

C: Supplement

The liquid ejecting apparatus exemplified in the above-described embodiment may be adopted not only for equipment dedicated to printing but also for various equipment such as a facsimile machine and a copying machine, and an application of the present disclosure is not particularly limited. However, the application of the liquid ejecting apparatus is not limited to the printing. For example, the liquid ejecting apparatus that ejects a solution of a coloring material is used as a manufacturing apparatus that forms a color filter of a display device such as a liquid crystal display panel. In addition, the liquid ejecting apparatus that ejects a solution of a conductive material is used as a manufacturing apparatus that forms wiring patterns or electrodes of a wiring substrate. In addition, the liquid ejecting apparatus that ejects a solution of an organic substance relating to a living body is used as a manufacturing apparatus that manufactures a biochip, for example.

Furthermore, advantageous effects described in the present specification are merely illustrative or exemplary, and are not limitative. That is, the present disclosure can achieve other advantageous effects that are obvious to those skilled in the art from the description of the present specification, in addition to the above-described advantageous effects or instead of the above-described advantageous effects.

Hitherto, the preferable embodiments according to the present disclosure have been described in detail with reference to the accompanying drawings. However, the present disclosure is not limited to the examples. It is obvious that a person having ordinary knowledge in the technical field of the present disclosure can conceive various modification examples or correction examples within the scope of the technical idea described in the appended claims. As a matter of course, it is understood that the modification examples or the correction examples belong to the technical scope of the present disclosure.

D: Appendix

For example, the following configurations are conceivable, based on the forms exemplified above.

According to an aspect (Aspect 1) of the present disclosure, there is provided a liquid ejecting head for ejecting a liquid in a first direction. The liquid ejecting head includes an upper surface facing a direction opposite to the first direction, and a gripping portion provided on the upper surface and gripped to move the liquid ejecting head. According to the above-described configuration, a user can easily move the liquid ejecting head by gripping and pulling the gripping portion. For example, when the liquid ejecting head fails, the gripping portion functions as a knob for moving the liquid ejecting head.

According to a specific example (Aspect 2) of Aspect 1, a cross section of the gripping portion which is orthogonal to the first direction may include four or more linear sides. According to this aspect, a user can grip the gripping portion regardless of his or her own orientation with respect to the liquid ejecting head.

According to a specific example (Aspect 3) of Aspect 1, a cross section of the gripping portion which is orthogonal to the first direction may have a substantially polygonal shape in which at least one corner of a polygon including four or more linear sides has an R-shape. According to this aspect, a user can grip the gripping portion regardless of his or her own orientation with respect to the liquid ejecting head.

According to a specific example (Aspect 4) of Aspect 1, a cross section of the gripping portion which is orthogonal to the first direction may have a substantially polygonal shape in which at least one side of a polygon including four or more linear sides swells in a direction away from a center of the gripping portion. According to this aspect, a user can grip the gripping portion regardless of his or her own orientation with respect to the liquid ejecting head.

According to a specific example (Aspect 5) of Aspect 1, a cross section of the gripping portion which is orthogonal to the first direction may have a substantially polygonal shape in which at least one corner of a polygon including four or more linear sides has an R-shape, and at least one side of the four or more linear sides swells in a direction away from a center of the gripping portion. According to this aspect, a user can grip the gripping portion regardless of his or her own orientation with respect to the liquid ejecting head.

According to a specific example (Aspect 6) of Aspect 2, the cross section may include five or six linear sides. According to this aspect, a user can grip the gripping portion in every direction without increasing a size of the gripping portion.

According to a specific example (Aspect 7) of Aspect 3 to Aspect 5, the polygon may include 5 or 6 linear sides. According to this aspect, a user can grip the gripping portion in every direction without increasing a size of the gripping portion.

According to a specific example (Aspect 8) of Aspect 2 to Aspect 7, a length of the linear side may be 1 cm or larger. According to this aspect, each side configuring the approximate polygon which is a cross-sectional shape of the gripping portion has a size substantially the same as a thickness of a human finger. Therefore, a user easily grips the gripping portion.

According to a specific example (Aspect 9) of Aspect 1 to Aspect 8, the gripping portion may have a first portion, and a second portion having a first side surface around an axis parallel to the first direction, and located between the first portion and the upper surface. The first portion may protrude from an entire periphery of the first side surface to a second direction perpendicular to the first direction. A maximum width of the first portion in a second direction is larger than a maximum width of the second portion in the second direction. According to this aspect, a user easily catches the first portion on his or her finger when gripping the second portion. Therefore, this configuration reduces a risk that the liquid ejecting head may slip off from the user's hand. Furthermore, the user can lift the liquid ejecting head by catching the gripping portion on an inner surface or a side surface of the finger. Accordingly, the user more easily replaces the head.

According to a specific example (Aspect 10) of Aspect 9, the first portion may have a second side surface facing the second direction. A distance between the second side surface and the second portion in the second direction may be 15 mm or larger.

According to a specific example (Aspect 11) of Aspect 9 or Aspect 10, a dimension of the second portion in the first direction may be 15 mm or larger.

According to a specific example (Aspect 12) of Aspect 10 or Aspect 11, at least one of the first side surface and the second side surface may have a continuous curved surface.

According to a specific example (Aspect 13) of Aspect 9 to Aspect 12, the gripping portion further may have a third portion provided between the second portion and the upper surface. A width of the second portion in the second direction may be narrower than a width of the third portion in the second direction.

According to a specific example (Aspect 14) of Aspect 13, a shortest distance between the first portion and the third portion in the first direction may be 15 mm or larger.

According to a specific example (Aspect 15) of Aspect 1, the gripping portion may have an opening. A diameter of an inscribed circle inscribed in the opening may be 15 mm or larger. According to this aspect, a user can pass his or her finger through the opening of the gripping portion. Therefore, the user more safely replaces the liquid ejecting head.

According to a specific example (Aspect 16) of Aspect 1 to Aspect 15, the gripping portion may be configured to pivot around an axis parallel to the first direction. According to this aspect, a user can grip the gripping portion without depend portioning on the user's orientation with respect to the liquid ejecting head.

According to a specific example (Aspect 17) of Aspect 1 to Aspect 16, the liquid ejecting head may further include a side surface around an axis parallel to the first direction. The gripping portion may have a higher coefficient of static friction than the side surface. According to this aspect, a user's finger is less likely to slip on the gripping portion. Accordingly, the user can stably grip the gripping portion. Therefore, the user more stably replaces the liquid ejecting head.

According to a specific example (Aspect 18) of Aspect 1 to Aspect 17, the gripping portion may have grooves around an axis parallel to the first direction. A plurality of the grooves may be provided along the first direction. According to this aspect, a user's finger is less likely to slip on the gripping portion. Accordingly, the user can stably grip the gripping portion. Therefore, the user more stably replaces the liquid ejecting head.

According to a specific example (Aspect 19) of Aspect 1 to Aspect 18, the gripping portion may have grooves provided along the first direction. A plurality of the grooves may be provided around an axis parallel to the first direction. According to this aspect, a user's finger is less likely to slip on the gripping portion. Accordingly, the user can stably grip the gripping portion. Therefore, the user more stably replaces the liquid ejecting head.

According to a specific example (Aspect 20) of Aspect 1 to Aspect 19, the gripping portion may have a plurality of recess portions. A diameter of the recess portion may be from 3 mm to 5 mm. According to this aspect, a user's finger is less likely to slip on the gripping portion. Accordingly, the user can stably grip the gripping portion. Therefore, the user more stably replaces the liquid ejecting head.

According to a specific example (Aspect 21) of Aspect 1 to Aspect 20, the gripping portion may have tackiness.

According to a specific example (Aspect 22) of Aspect 1 to Aspect 21, the gripping portion may have elasticity.

According to a specific example (Aspect 23) of Aspect 1 to Aspect 22, the gripping portion may be partially or entirely formed of an elastomer.

According to another aspect (Aspect 24) of the present disclosure, there is provided a liquid ejecting apparatus including the liquid ejecting head according to any one of Aspect 1 to Aspect 23, and a holding member holding the liquid ejecting head to be attachable and detachable.

In a specific example (Aspect 25) of Aspect 24, the holding member may hold a plurality of the liquid ejecting heads. A distance between the two liquid ejecting heads adjacent to each other may be 15 mm or smaller.

What is claimed is:

1. A liquid ejecting head configured to eject a liquid in a first direction, comprising:

an upper surface facing a direction opposite to the first direction; and a gripping portion provided on the upper surface to grip the liquid ejecting head, wherein a cross section of the gripping portion which is orthogonal to the first direction has a substantially polygonal shape in which at least one corner of a polygon including four or more linear sides has an R-shape, or wherein the gripping portion has a first portion, and a second portion having a first side surface around an axis parallel to the first direction, and located between the first portion and the upper surface, the first portion protrudes from an entire periphery of the first side surface to a second direction perpendicular to the first direction, and a maximum width of the first portion in the second direction is larger than a maximum width of the second portion in the second direction, or wherein the gripping portion has an opening, and a diameter of an inscribed circle inscribed in the opening is 15 mm or larger, or wherein the gripping portion is configured to pivot around an axis parallel to the first direction, or wherein a side surface of the liquid ejecting head extends along the first direction and a direction orthogonal to the first direction, and the gripping portion has a higher coefficient of static friction than the side surface, or wherein the gripping portion has grooves provided along the first direction, and each of the grooves extends around an axis parallel to the first direction, or wherein the gripping portion has grooves provided along an axis parallel to the first direction, and each of the grooves extends in the first direction, or wherein the gripping portion has a plurality of recess portions, and a diameter of the recess portion is from 3 mm to 5 mm, or wherein the gripping portion has tackiness.

2. The liquid ejecting head according to claim 1, wherein a cross section of the gripping portion which is orthogonal to the first direction includes four or more linear sides.

3. The liquid ejecting head according to claim 1, wherein a cross section of the gripping portion which is orthogonal to the first direction has a substantially polygonal shape in which at least one side of a polygon including four or more linear sides swells in a direction away from a center of the gripping portion.

4. The liquid ejecting head according to claim 1, wherein a cross section of the gripping portion which is orthogonal to the first direction has a substantially polygonal shape in which at least one corner of a polygon including four or more linear sides has an R-shape, and at least one side of the four or more linear sides swells in a direction away from a center of the gripping portion.

5. The liquid ejecting head according to claim 1, wherein the first portion has a second side surface facing the second direction, and a distance between the second side surface and the second portion in the second direction is 15 mm or larger.

6. The liquid ejecting head according to claim 1, wherein a dimension of the second portion in the first direction is 15 mm or larger.

7. The liquid ejecting head according to claim 5, wherein at least one of the first side surface and the second side surface has a continuous curved surface.

8. The liquid ejecting head according to claim 1, wherein the gripping portion further has a third portion provided between the second portion and the upper surface, and a width of the second portion in the second direction is narrower than a width of the third portion in the second direction.

9. The liquid ejecting head according to claim 8, wherein a shortest distance between the first portion and the third portion in the first direction is 15 mm or larger.

10. A liquid ejecting apparatus comprising:

the liquid ejecting head according to claim 1; and a holding member holding the liquid ejecting head to be attachable and detachable.

11. A liquid ejecting apparatus comprising:

first and second liquid ejecting heads configured to eject a liquid in a first direction, the first and second liquid ejecting heads each comprising:

an upper surface facing a direction opposite to the first direction; and a gripping portion provided on the upper surface to grip the liquid ejecting head; and a holding member holding the first and second liquid ejecting heads to be attachable and detachable, wherein a distance between the first and second liquid ejecting heads adjacent to each other is 15 mm or smaller.

* * * * *